United States Patent [19]

Omura et al.

[11] 4,374,463

[45] Feb. 22, 1983

[54] APPARATUS FOR PROCESSING SHEET LIKE MATERIALS

[75] Inventors: Hideo Omura; Shigeo Horino, both of Tokyo, Japan

[73] Assignee: Tokyo Shibaura Denki Kabushiki Kaisha, Kawasaki, Japan

[21] Appl. No.: 162,485

[22] Filed: Jun. 24, 1980

[30] Foreign Application Priority Data

Jun. 29, 1979 [JP] Japan ..... 54-81460

[51] Int. Cl.[3] ..... B65B 13/06; B65B 27/08

[52] U.S. Cl. ..... 53/54; 53/542; 53/589; 53/593

[58] Field of Search ..... 53/54, 542, 587, 588, 53/589, 593

[56] References Cited

U.S. PATENT DOCUMENTS

| | | | |
|---|---|---|---|
| 1,123,606 | 1/1915 | Smith | 53/587 X |
| 2,612,737 | 10/1952 | Thielens | 53/593 X |
| 3,470,814 | 10/1969 | Tschappo | 53/589 X |
| 3,675,386 | 7/1972 | Sels | 53/506 |
| 4,014,231 | 3/1977 | Muto | 53/588 X |
| 4,020,616 | 5/1977 | Nakajima | 53/587 X |
| 4,126,982 | 1/1978 | Ito | 53/593 |
| 4,141,193 | 2/1979 | Joa | 53/542 X |

FOREIGN PATENT DOCUMENTS

| | | | |
|---|---|---|---|
| 2419219 | 11/1979 | France | 53/542 |
| 1305394 | 1/1973 | United Kingdom . | |
| 1464987 | 2/1977 | United Kingdom . | |

*Primary Examiner*—John Sipos

*Attorney, Agent, or Firm*—Cushman, Darby & Cushman

[57] ABSTRACT

Unit sheet-stacks each as a stack of a given number of sheets are successively transferred to a bundling device for bundling the unit sheet-stacks. The bundling device includes a unit sheet-stack transfer mechanism, a mechanism for previously forming a bundling loop, and a mechanism for bundling the unit sheet-stack. The transfer mechanism receives the unit sheet-stack in a state that each sheet is postured substantially horizontally and transfers the unit sheet-stack in a state that each sheet is postured substantially vertically to a given position. The bundling loop forming mechanism previously forms a bundling loop by winding the free end portion of a tape by a given number of turns. The bundling mechanism includes a device for inserting the unit sheet-stack fed from the transfer mechanism into the bundling loop in a state that each sheet is postured substantially vertically, a device for squeezing the bundling loop around the unit sheet-stack inserted, and a device for bonding the outer portion of the squeezed bundling loop onto the peripheral portion of the bundling loop.

8 Claims, 30 Drawing Figures

APPARATUS FOR PROCESSING SHEET LIKE MATERIALS

BACKGROUND OF THE INVENTION

The present invention relates to an apparatus for processing sheet like materials such as securities, for example, checks or slips, which are supplied with sheet like materials of the same kind, classifying them into several classes, stacking the sheet like materials of the same class to make a unit sheet-stack, and bundling the unit sheet-stack.

In an apparatus for processing sheet like materials recently developed and currently used, securities are classified in accordance with a predetermined standard into several different groups. Each of those groups is counted and stacked into a unit sheet-stack having a predetermined number of sheet like materials. Finally, those sheet-stacks are bundled.

An apparatus of this type is disclosed in U.S. Pat. No. 4,020,616, for example. For processing the sheet like materials, the apparatus has a sequence of steps. Firstly, sheet like materials (referred to as sheets) such as bank notes or checks are set in sheet supply section; the sheets set are successively taken out sheet by sheet; the taken-out sheets are inspected under a given inspecting condition and classified into three groups including a normal sheet group, a solid sheet group and an unidentifiable sheet group. The normal sheets are effective and reusable. The soiled sheets are effective but not reusable. The unidentifiable sheets are those which are unidentifiable in the inspection section, for example, those sheets taken out superposedly, or those sheets not to be processed by the apparatus now used. In this respect, the unidentifiable sheet will be referred to as a sheet to be rejected or an unidentifiable sheet. After the classifying step, the normal and soiled sheets are stacked into a corresponding unit sheet-stack having, for example, 100 sheets, and then the unit sheet-stack is bundled.

In stacking and bundling, for example, the normal sheets by the above-mentioned apparatus, the normal sheets are stacked every 100 sheets, being disposed horizontally, thereby to form unit sheet-stacks. The unit sheet-stacks are descended to a carrier position by a lift or a back-up plate which is vertically movable. Then, the unit sheet-stacks are transferred to a bundling section by a transfer belt which is horizontally movable. In bundling the unit sheet-stacks, the unit sheet-stacks are transferred to a bundling device including small revolving rollers and large rollers rotating about the small rollers. When a unit sheet-stack is supplied to the bundling device, a separation knife separates the unit sheet-stack into the upper and lower sub-stacks. One end of a bundling tape is inserted between the separated upper and lower sub-stacks. Then, while the unit sheet-stack is clamped by the small rollers, the bundling tape is wound around the unit sheet-stack by rotating the large rollers.

The conventional sheet like material processing apparatus, however, has the following disadvantages.

(1) When the normal unit sheet-stack placed horizontally on the lift or back-up plate is descended and transferred to the transfer belt which horizontally travels, the stacked state of the unit sheet-stack is destroyed unless a unit sheet-stack holding device is provided. If destroyed, the unit sheet-stack including a predetermined number of sheets may have an insufficient number of sheets, and some sheets may fall on the near transfer belt, possibly causing a jam. Further, the transfer distance from the sheet stacking location to the sheet bundling location is elongated, so that it is difficult to minimize the size of the apparatus.

(2) In horizontally transferring the normal unit sheet-stack, the sheet-stack is separated into the upper and the lower sub-stacks by the separating knife. This separating operation further tends to cause the further bending or breaking of a bent portion or broken portion of a sheet included in the unit sheet-stack, so that the unit sheet-stack is often unreliably separated. The unreliable separation indicates that the bundling tape is unreliably inserted into the unit sheet-stack.

(3) In the bundling device, the interval between the pairs of small rollers, oppositely disposed, for clamping the unit sheet-stack, is fixed. Accordingly, when the thickness of the unit sheet-stack is not fixed, the upper or the lower sheets of the unit sheet-stack may be driven out from the bundling device. The variation of the thickness of the unit sheet-stack follows the fact that sheets to be stacked are always not straightened horizontally in their natural state when they are individually laid.

(4) As described above, the bundling tape inserting position is far removed from the tape bonding position of the tape wound around the unit sheet-stack. The relatively long distance therebetween necessitates providing special means for maintaining the bundling tape is inserted into the unit sheet-stack, for winding a tape around the unit sheet-stack, for tightening the unit sheet-stack and for holding the tightening state. Unless those means are provided, the bundling tape slips off the unit sheet-stack, so that the unit sheet-stack can not be bundled tightly. If those means are employed, the construction related is complicated and a complicated control circuit for the additional structure is required. In this respect, the approach to use those means is not practical.

One of the approaches to solve the disadvantages in items (1) to (4) is some modification of the conventional technique. For example, the technique disclosed in English Patent specification No. 1305394 may be applied to solve the disadvantages of items (1) and (3). The English Patent arrangement may change the position of the stack while the unit sheet-stack in which each sheet is positioned horizontally are clamped. Therefore, it may prevent the stacked state of the sheets from being destroyed and may shorten the distance from the sheet stacking location to the unit sheet-stack bundling location. However, when one unit sheet-stack is bundled, it is impossible to stack the sheets for obtaining a succeeding unit sheet-stack. For this reason, this technique can not be adapted for the apparatus for continuously processing the sheets at a high speed. Further, since the bundling tape is merely wound around the unit sheet-stack when the unit sheet-stack is moved while being rotated, it can not bundle the unit sheet-stack tightly. In the process where the unit sheet-stack is rotated, the bundling tape is wound around the stack, so that a centrifugal force acts on the unit sheet-stack thereby to possibly provide a poor clamping of the unit sheet-stack.

For solving the problems mentioned in items (2) and (3), the technique disclosed in English Patent No. 1464987 might be used. According to the patent, the bundling tape is inserted into the unit sheet-stack while the unit sheet-stack is held in a static state, with the result that the tape inserting operation is reliably performed. The patent, however, is imappropriate for continuously processing sheets at a high speed. In the patent, the clamping force of the clamp plate for clamping the unit sheet-stack may be adjusted by a cam. Therefore, the disadvantage in item (2) may be solved. Since the interrelation between the clamp plate and the cam is fixed, it is very difficult to taking a timing between the releasing operation of the clamp plate and the transfer operation of the sheet-stack from the clamp plate. The reason for this is that the clamp plate has no margin of the clamping force in the direction of the reactive force. Accordingly, it is almost impossible to transfer the unit sheet-stack from the clamp plate, so long as the clamp plate is not released from the unit sheet-stack perfectly. The approach requiring such a complicated timing adjustment is not adapted for continuously processing sheets at a high speed.

SUMMARY OF THE INVENTION

Accordingly, an object of the present invention is to provide an apparatus for processing sheet like materials capable of continuously processing sheet like materials at a high speed, having an improved bundling device for bundling a unit sheet-stack including a given number of sheet like materials stacked.

The present invention provides as an apparatus for processing sheet like materials comprising: a unit sheet-stack transfer mechanism which receives a unit sheet-stack as a stack of a given number of sheet like materials in a state that the respective sheet like materials are postured substantially horizontally, and transfers the unit sheet-stack to a given position in a state that the respective sheets are postured substantially vertically; a mechanism for previously forming a bundling loop for bundling the unit sheet-stack by winding by given turns the free end portion of tape fed from a tape feeding source; and a bundling mechanism having means for inserting the unit sheet-stack into the bundling loop while the respective sheets are postured in the substantially vertical state, means for tightening the bundling loop to squeeze the inserted unit sheet-stack, and means for bonding the outer end portion of the bundling loop tightened to the outer periphery portion of the bundling loop.

BRIEF DESCRIPTION OF THE DRAWINGS

The invention will be better understood from the following description taken in connection with the accompanying drawings, in which:

FIGS. 3 through 6 illustrate a detailed structure of a unit sheet-stack forming device used in the apparatus shown in FIG. 1, in which FIG. 3 is a front view of the sheet-stack forming device, FIG. 4 is a plan view thereof, FIG. 5 is a side view thereof and FIG. 6 is a partial front view thereof;

FIGS. 7 and 8 illustrate a detailed structure of a unit sheet-stack bundling device used in the apparatus shown in FIG. 1, in which FIG. 7 is a side view of the bundling device and FIG. 8 is a plan view;

In connection with the accompanying drawings, directions such as "upward" and "rightward" refer to the invention as viewed in the respective drawings. Further, corresponding parts or portions of different drawings have been given like reference symbols.

DETAILED DESCRIPTION OF THE PREFERRED EMBODIMENT

Figure 1:
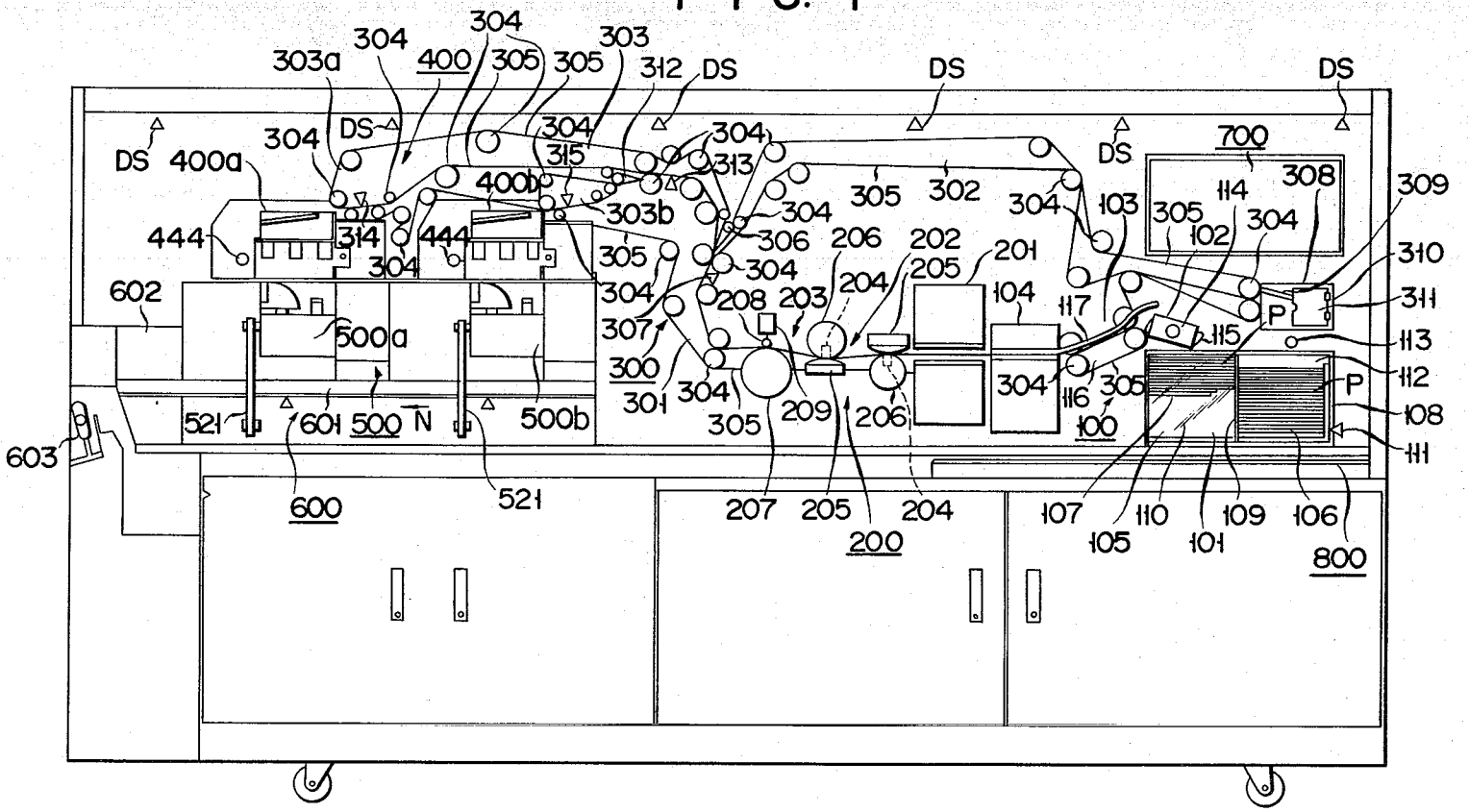
FIG. 1 is a schematic diagram illustrating a front of an overall apparatus for processing sheet like materials which is an embodiment according to the invention.

In an apparatus for processing sheet like materials such as securities, for example, checks or slips, a specific feature of the sheet like materials is detected while those sheet like materials are transferred sheet by sheet. The sheet like materials are classified on the basis of the feature detected, and those classified sheet like materials are stacked for each classification into unit sheet-stacks. Finally, the unit sheet-stacks are bundled. Securities such as checks or slips, handled in the apparatus are classified into the following three:

(1) Normal sheet: A sheet judged to be normal and available as the result of its inspection and, after it is processed by the apparatus, is used again in its field.

(2) Soiled sheet: A sheet judged to be normal and available as the result of its inspection and, after it is processed by the apparatus, is collected by the issuing side and is discarded.

(3) An unidentifiable sheet or sheet to be rejected: This sheet includes an invalid sheet, an unidentifiable sheet and a foreign sheet. The invalid sheet is the one judged to be false or invalid. The unidentifiable sheet is the one which can not be inspected for the reason that the sheet has a great scar or scars or is taken out in a state superposed with another sheet. The foreign sheet is a sheet different from the sheet to be processed by the apparatus.

Of those securities classified such as the normal sheets, the soiled sheets and the unidentifiable sheets, the normal sheets and the soiled sheets are stacked into unit sheet-stacks each including 100 sheets. The unidentifiable sheets are again processed by the apparatus of the invention for properly processing the superposedly taken out sheets. Those sheets judged as the unidentifiable sheets, even after the second processing by the apparatus, are processed manually by an operator.

The normal and soiled unit sheet-stacks are each transferred to a corresponding proper station as a 100-sheet-stack. At this stage, the 100-sheet-stack or unit sheet-stack is merely stacked but not yet bundled. Then, those unit sheet-stacks are bundled at the proper station. This bundling operation will be called merely "bundling". The bundling is performed in a manner that a bundling tape such as a paper tape is looped around the unit sheet-stack and the external end of the loop is bonded to the outer periphery of the wounded portion. The unit sheet-stack bundled in this way will be called a bundled unit sheet-stack. In the embodiment, the normal unit sheet-stack is bundled by a green paper tape;

the soiled unit sheet-stack by a yellow paper tape. The bundled unit sheet-stacks of the normal and soiled sheets are transferred through the same transfer path. In the way of the transfer, the name of the operator, the date and the like are stamped on the bundled sheet-stack. The stamp is made on the bundling tape. After the stamping, the bundled normal and soiled unit sheet-stacks are separately collected and every ten bundled unit sheet-stacks is further bundled into a larger unit. The explanation to follow is the elaboration of the sheet like material processing apparatus which performs the above-mentioned processing in continuous manner, relating to the construction and the operation mainly.

GENERAL CONSTRUCTION

As shown in FIG. 1, the sheet like material processing apparatus according to the invention comprises a sheet take-out/transfer device 100, a sheet inspection device 200, a sheet transfer/sorting or classifying device 300, a unit sheet-stack forming device 400, a unit sheet-stack bundling device 500, a bundled unit sheet-stack classifying or sorting device 600, a display device 700 (FIG. 13) and a control device 800 (FIG. 14). The sheet take-out/transfer device takes out securities P (referred merely to as sheets) stacked in vertical direction sheet by sheet by means of a vacuum means and transfers them to the sheet inspection device 200. The sheet inspection device 200 performs a predetermined inspection about the incoming sheets P. The sheet transfer/-classifying device 300 classifies each sheet P passed through the inspection device 200 on the basis of the result of the inspection and then transfers it to the unit sheet-stack forming device 400. The unit sheet-stack forming device 400 stacks the normal or soiled sheets transferred through the sheet transfer/classifying device 300 for every 100 sheets, being held horizontally thereby to form the normal unit sheet-stack or the soiled unit sheet-stack. Then, those stacks are transferred to the unit sheet-stack bundling device 500. The unit sheet-stack forming device 400 comprises a normal unit sheet-stack forming device **400*a* and a soiled unit sheet-stack forming device 400*b*. The sheet-stack bundling device 500 comprises a normal unit sheet-stack bundling device 500*a* and a soiled unit sheet-stack bundling device 500*b*. The bundled unit sheet-stack classifying device 600 classifies the bundled unit sheet-stacks transferred from the bundling device 500 into the bundled normal unit sheet-stacks and the bundled soiled unit sheet-stacks, and collects them at the corresponding places, respectively. The display device 700 (FIG. 13**) displays on a graphic panel operating states such as the number of the sheets processed, trouble locations, and error contents.

SHEET TAKE-OUT AND TRANSFER

With continuing reference to FIG. 1, the sheet take-out and transfer device 100 is comprised of a sheet supply section 101, a sheet take-out section 102, a sheet receiving section 103, and a sheet cleaner section 104. The sheet supply section 101 is separated into a left sheet supply chamber 105 and a right sheet supply chamber 106, which respectively contain sheet pressing boards 107 and 108. Provided between both the supply chambers 105 and 106, a parting plate 109 which is slidable vertically. The sheet pressing plate 107 pushes up the sheets P placed thereon and presses them against the sheet take-out section 102 side with a fixed pressure. The sheet pressing plate 108, shaped like an inverse L, transfers the sheets P in the right supply chamber 106 to the left sheet supply chamber 105. The horizontal part of the sheet pressing plate 108 has a number of rod like members arranged like a drain board so as to couple with the bottom part of the left sheet supply chamber 105 in a telescopic manner. The sheets P stacked are placed on the drain board bottom of the left sheet supply chamber 105. The vertical part of the sheet pressing board 108 trues up vertically one side edges of the sheets P placed on the horizontal part thereof.

In front of the sheet supply section 101, a cover 110 which is transparent and slidable between both the sheet supply chambers 105 and 106. The transparent cover 110 normally closes the front opening section of the right sheet supply chamber 106, while is moved to close the front opening section of the left sheet supply chamber 105 only when the sheets P are supplied onto the sheet pressing plate 108, supplementally. Such a movement of the cover 110 is sensed by a sensor 111 and, in response to the sensing signal from the sensor 111 the parting plate 109 ascends from the bottom surfaces of the sheet supply chambers 105 and 106, so that both the chambers 105 and 106 become partitioned. Incidentally, the parting plate 109 is normally placed below the bottom surface of the supply chambers 105 and 106. On the opposite side to the cover 110 of the sheet supply chambers 105 and 106, a reference plane 112 is provided which regulates from the rear side of the apparatus another side edges of the sheets P accommodated in both the chambers 105 and 106 for arranging the another side edges vertically. The reference plain is slidable back and forth as viewed in the apparatus by operating a sheet kind setting dial 113. The sheet kind setting dial 113 is used to set kinds of the sheets P to be handled by the apparatus. The apparatus of the present embodiment handles four kinds of sheets W, X, Y and Z, for example, with different widths and lengths. This is the reason for sliding the reference plane 112 back and forth as in the drawing for setting the regulating position of the rear edges of the stacked sheets P in accordance with the width of the sheets P to be handled.

The sheet take-out section 102 comprises rotor 114 rotating clockwise and absorbing chips 115 and 115 provided on both sides of the rotor 114. The rotor 114 is rotated clockwise by a drive source (not shown). The absorbing chip 115 is shaped such that the thickness thereof gradually decreases in the rotating direction of the rotor 114, and has a smoothed surface. The absorption chip 115 has absorbing holes (not shown) at the surface which communicate with a vacuum device (not shown). The sheet receiving section 103 transfers the sheets P taken out by the take-out section 102 to the sheet transfer/classifying device 300, and comprises a transfer path 116 succeeding to the sheet transfer/classifying device 300 and a guide plate 117. A sheet cleaning section 104 communicates with a vacuum device (not shown) to clean dust attached to the sheet P transferred by the transfer/classifying device 300 by absorbing it. The cleaning section 104 lessens an adverse effect of the dust upon the inspection by the inspection device 200 to be described later.

The operation of the take-out/transfer device 100 will now be described. Firstly, a kind of the sheet to be processed is set by operating the sheet kind setting dial 113. Upon the operation of the dial 113, the reference plane 112 moves in the front or rear side direction as viewed in the drawing thereby to set the width of the sheet selected. In the initial stage, the sheet pressing plate 107 is set at a fixed position at the bottom of the sheet supply chamber 105. Under this condition, the cover 110 is moved from the sheet supply chamber 106 to the sheet supply chamber 105. Upon the movement of the cover 110, the sensing device 111 produces a sensing signal which in turn causes the parting plate 109 to move upward to partition the chamber into the right and left sheet supply chambers 105 and 106. At this stage, the operator stacks the sheets P in thousands and places the sheet-stack on the horizontal part of the sheet pressing plate 108. The stacked sheets P are positioned in place by the vertical part of the sheet pressing plate 108, the reference plane 112 and the parting plate 109. Then, the cover 110 is moved to close the front opening of the sheet supply chamber 106. The movement of the cover 110 is sensed by the sensor 111 and the sensor 111 produces a sensing signal which in turn causes the parting plate 109 to move downward to be below the bottom surface of the sheet supply chambers 105 and 106. And the sheet pressing plate 108 moves toward the supply chamber 105 while carrying the stacked sheets P on the horizontal part of the pressing plate 108.

At this time, the sheet pressing plate 108 is smoothly set in the sheet supply chamber 105 without being arrested by the sheet pressing plate 108 and the sheet supply chamber 105, since the bottom of the sheet supply chamber 105 and the horizontal portion of the sheet pressing plate 108 have each a number of rod-like members arranged in a drain board so as to be coupled with each other in a telescopic manner. In place of the sheet pressing plate 108, the sheet pressing plate 107 carries the stacked sheets P and goes up while carrying them to push upwardly the stacked sheets P at a given pressure. At the same time, the pressing plate 108 moves to the right side to be set at a given position in the sheet supply chamber 106. Under this set condition, by operating a start switch (see FIG. 14) 91*b* to be given later, the rotor 114 is rotated clockwise and the absorbing chip 115 absorbs the uppermost sheet P in the sheet supply chamber 105 to take out it and to transfer the take-out one to the sheet receiving section 103. The take-out sheet P is transferred along the guide plate 117 and through the transfer path 116 to the cleaner section 104 where dust attached thereto is removed. Then, the sheet P is transferred to the sheet inspection device 200.

While the sheets P set in the sheet supply chamber 105 are being taken out therefrom sheet by sheet by the take-out section 102, the cover 110 is moved to the sheet supply chamber 105 to supply the next sheets P onto the sheet pressing plate 108. When the cover 110 is moved to the sheet supply chamber 105, the sensor 111 senses the movement thereof to raise the parting plate 109 from the bottom surfaces of the supply chambers 105 and 106. As the sheets P are supplied to the sheet supply chamber 106, the cover 110 is returned to a fixed position, or the sheet supply chamber 106 side, so that the parting plate 109 falls below the bottom surfaces of the chambers 105 and 106. In this case, by operating a continuous take-out switch 917 (FIG. 14A) to be given later, the sheets P in the sheet supply chamber 105 is taken out and at this time the sheets P in the sheet supply chamber 106 is automatically transferred to the sheet supply chamber 105. In this way, the sheets P is continuously taken out.

INSPECTION

The sheet inspection device 200 (FIGS. 1 and 2) comprises an optical inspection section 201, a magnetic inspection section 202, and a mechanical inspection section 203. The optical inspection section 201 illuminates visible rays onto the incoming sheet P, and receives the reflecting light from the sheet P and the transmitted light through the sheet P to convert the received light into a corresponding electric signal thereby to sense an optical feature of the sheet P in accordance with a given logic. The magnetic inspection section 202 senses a magnetic feature of the sheet P by sensing a magnetism of the sheet P. The magnetic inspection section 202 comprises two magnetic heads 204 and 204, two pressure pads 205 and 205 for pressing the sheet P against the magnetic heads 204 and 204, and two holding rollers 206 and 206 disposed flush with the magnetic heads 204 and 204 to support the transfer belt of the sheet transfer/classifying device 300. To be more specific, the holding rollers 206 and 206 partially presses the transfer belt 305 toward the pressure pads 205 and 205. Further, the pressure pads 205 and 205 press the sheet P against the magnetic heads 204 and 204 thereby to make the sheet P closely contact with the head surfaces of the magnetic heads 204 and 204, whereby a good magnetic-electric conversion is ensured. The mechanical inspection section 203 inspects the thickness of the sheet P to detect the superposedly taken-out sheets or foreign sheets, and is installed fixedly. The mechanical inspection device 203 comprises a reference roller 207 of which the peripheral surface is invariably positioned, an oscillatory roller 208 for pressing the incoming sheet P against the reference roller 208, a sensor 209 for sensing a displacement of the oscillatory roller 208 by means of an optical means, for example. With respect to a position of the oscillatory roller 208 in a state that one normal sheet P intervenes between the reference roller 207 and the oscillatory roller 208, a displacement of the oscillatory roller 208 produced when a sheet P thicker than the above sheet intervenes therebetween. The reference roller 207 is tubular and integrally formed with a uniform peripheral surface. The oscillatory roller 208 is comprised of a plurality of small rollers disposed opposite to the reference roller 207. Specifically, regarding to the small rollers, a plurality of rollers are arranged along the axis of the reference roller 207, corresponding to the positions for sensing the thickness of the sheet P. In respect of the sensor 209, a plurality of sensors for sensing a displacement of the oscillatory roller 208 are provided corresponding to the oscillatory roller 208.

Figure 2:
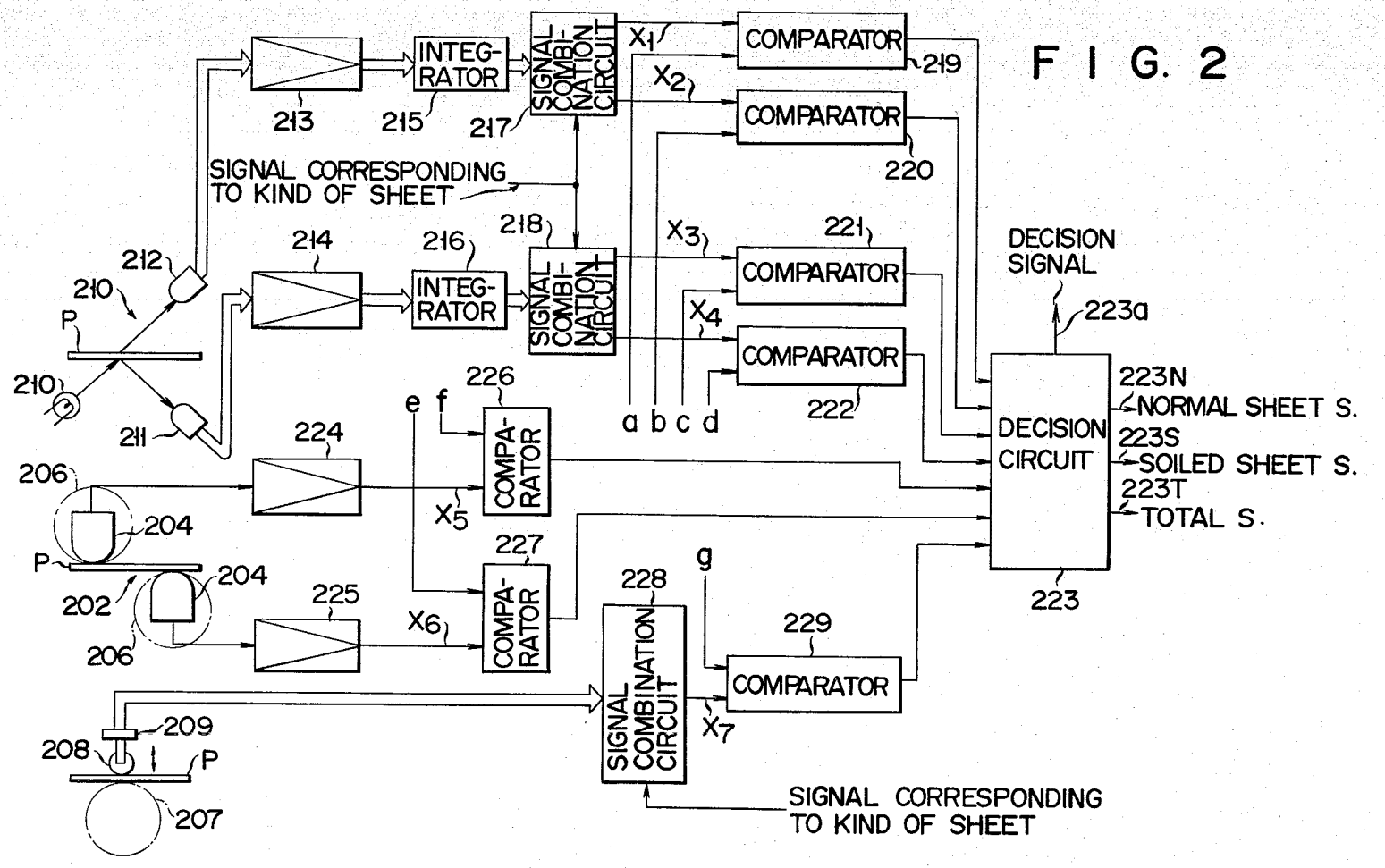
FIG. 2 is a block diagram of a sheet inspection device used in the apparatus shown in FIG. 1.

The sheet inspection device 200 will further be described referring to FIG. 2. The optical inspection section 201 comprises a light source 210 for illuminating the sheet P, a light receiving element 211 for receiving the light reflecting from the sheet P, and a light sensing element 212 for receiving the light transmitted through the sheet. Actually, the light receiving elements 211 and 212 are provided at the positions for sensing an optical feature of the sheet P; however, these are illustrated generally as the receiving elements 211 and 212, for simplicity of illustration. With this arrangement, both the light receiving elements 211 and 212 convert the reflecting light and the transmitted light into corresponding electric signals, respectively. Those electric signals are transferred to the amplifiers 213 and 214, respectively. The amplifiers 213 and 214 amplify the signals from the light receiving elements 211 and 212 to given signal levels and then transfer them to integrators 215 and 216, respectively. Upon receipt of the output signals (analog signals) from the amplifiers 213 and 214, the integrators integrate for a given time and then apply them to signal combination circuits 217 and 218, respectively. In response to a sheet kind setting signal representing a kind of the sheet P to be inspected, the signal combination circuits 217 and 218 respectively combine the plurality of the output signals from the integrators 215 and 216, on the basis of a given combination. The signals produced from these combination circuits 217 and 218 are an analog signal X1 formed on the basis of transmitted light from the sheet P for inspecting a degree of dirt of the sheet P, an analog signal X2 formed on the basis of the transmitted light from the sheet P for inspecting as to if the sheet is false or not, an analog signal X3 formed on the basis of the reflecting signal from the sheet P for inspecting a degree of dirt of the sheet P, and an analog signal X4 formed on the basis of the reflecting light from the sheet P for inspecting as to if the sheet P is false or not. Those signals X1 to X4 are transferred to comparators 219 to 222 where those are compared with a, b, c and d, respectively. The reference signals a to d are analog signals having signal levels representing the kinds of the sheets P to be inspected. Of those signals, the reference signals b and d have the given widths b1 to b2, and d1 to d2, respectively. The results of the comparisons by the comparators 219 to 222 are transferred to a decision circuit 223.

The magnetic heads 204 and 204, respectively, detect the magnetism developed from the obverse and reverse sides of the sheet P, and convert them into corresponding electric signals. These electric signals converted are applied to the corresponding amplifiers 224 and 225, respectively. The amplifiers 224 and 225 amplify the signals derived from the magnetic heads 204 and 204 to given signal levels, respectively. Those amplified signals X5 and X6 are further applied to the comparators 226 and 227. Upon receipt of those signals, the comparators 226 and 227, respectively, compare those signals with the reference signals e and f. The reference signals e and f are analog signals with the levels corresponding to a kind of sheets to be processed and have the given widths e1 to e2, and f1 to f2, respectively. The results of the comparisons by the comparators 226 and 227 are transferred to the decision circuit 223.

The oscillatory roller 208 responds to the thickness of the sheet P to be inspected to displace vertically. A displacement in excess of a given value causes the sensor 209 to operate, with a recognition that the sheets P are superposedly taken out and a foreign sheet is present. As a result, the sensor 209 produces a sensing signal corresponding to the displacement, which in turn is transferred to the signal combination circuit 228. The signal combination circuit 228 as a kind of a gate circuit responds to the sheet kind setting signal to combine the signals from the sensor 209 on a given combination and to produce the analog signal X7 representing the thickness of the sheet P. The signal X7 is transferred to the comparator 229 where it is compared with a reference signal g which is an analog signal with a level inherent to the kind of the sheet P to be inspected and has a width ranging between g1 to g2. In this way, the comparator 229 transfers the comparison result as a signal representing an abnormal thickness of the sheet P to be inspected (for example, the superposedly taken out sheet or the foreign sheet) to the decision circuit 223.

The reference signals a to g are generated from a reference signal generator (not shown), corresponding to the respective sheet kinds setting signals. The reference signal generator may be an analog memory for selectively producing an analog signal in accordance with the sheet kind setting signal or the combination of a fixed memory addressed by the sheet kind setting signal and a D/A converter for converting a digital signal derived from the fixed memory into an analog signal. The sheet kind setting signal is produced when the sheet setting dial 113 (FIGS. 1 and 2) is operated and indicates what kind of sheet P is now processed by the apparatus now.

The decision circuit 223 decides the sheets P as in the following table on the basis of the comparison results of the comparators 219, 220, 221, 222, 226, 227 and 229.

TABLE

| DECISION PRIORITY | SHEET CLASSIFICATION | | CONDITIONS TO BE SATISFIED |
|---|---|---|---|
| 1 | SHEETS TO BE REJECTED | INVALID SHEET<br>OVERLAPPED SHEET<br>FOREIGN SHEET | X2 > b2, OR b1 > X2, OR<br>X4 > d2, OR d1 > X4, OR<br>X5 > e2, OR X5 < e1, OR<br>X6 > f2, OR X6 < f1<br>X7 > g2, OR X7 < g1 |
| 2 | SOLID SHEET | | b1 ≦ X2 ≦ b2, AND d1 ≦ X4 ≦ d2,<br>AND e1 ≦ X5 ≦ e2, AND<br>f1 ≦ X6 ≦ f2, AND<br>g1 ≦ X7 ≦ g2, FURTHER<br>X1 < a OR X3 < C |
| 3 | NORMAL SHEET | | X1 ≧ a, AND b1 ≦ X2 ≦ b2,<br>AND X3 ≧ C, AND<br>d1 ≦ X4 ≦ d2, AND<br>e1 ≦ X5 ≦ e2, AND<br>f1 ≦ X6 ≦ f2, AND<br>g1 ≦ X7 ≦ g2 |

The decision circuit 223 judges the sheets P to decide the classes of the sheets P and produce various signals; a decision signal **223*a*, a soiled sheet signal 223S representing a soiled sheet, a normal sheet signal 223N representing a normal sheet, and a total signal 223T representing the total of the normal and soiled sheets. The decision signal 223*a* is used as a transfer and classifying control signal of the sheets P. The soiled, normal and total signals 223N, 223S and 223T are used as count signals respectively. The respective signals derived from the decision circuit 223 are transferred to a control device (FIGS. 14A and 14B**) to be described later.

TRANSFER AND CLASSIFYING

The transfer and classifying device 300 (see FIG. 1) is mainly comprised of a first transfer path 301, a second transfer path 302, and a third transfer path 303. Those transfer paths includes each drive or follower rollers 304, 304, . . . and transfer belts 305, 305, . . . wound around those rollers. The transfer sheet P is nipped by the surfaces, confronting with each other, of the transfer belts 305, 305, . . . , and is transferred to the succeeding stage. The first transfer path 301 extends through the sheet receiving section 103, the sheet cleaner section 104 and the sheet inspection device 300. The second transfer path 302 is provided at its branching point with a first classifying gate 306. The first classifying gate 306, so designed to swing when it is driven by a rotary solenoid (not shown), guides the sheet P transferred from the inspection device 200 in response to the decision signal 223*a* (FIG. 2) to the second transfer path 302 or the third transfer path 303. A detector such as an optical detector is provided preceding to the first classifying gate 306. The detector 307 detects the sheet P transferred through the first transfer path 301 and produces a detecting signal. At the time that the detecting signal is produced, the first classifying gate 306 is swung.

The end portion of the second transfer path 302 is positioned above the sheet supply section 101. At the end portion, a rejected sheet pile-up section 308 is provided which includes a guide plate 309 coupled with the end portion of the second transfer path 302, a sheet pile-up or stacking box 310 for piling up or stacking rejected sheets P falling guided by the guide plate 309, and a door 311 for opening and closing the front opening of the sheet stacking box 310. The third transfer path 303 comprises a normal sheet transfer path 303*a* and a soiled sheet transfer path 303*b*. At the branching point of both the transfer paths 303*a* and 303*b*, a second classifying gate 312 is provided. The second classifying gate 312, constructed like the first classifying gate 306, responds to the decision signal 223*a* (FIG. 2) to guide the sheet P transferred from the inspection device 200 to the normal sheet transfer path 303 or the soiled sheet transfer path 303*b*. Also preceding to the second classifying gate 312 is provided an optical, for example, detector 313. The detector 313 detects the sheet P transferred through the third transfer path to produce a detecting signal. At the timing of the production of the detecting signal, the second classifying gate 312 is swung. The normal sheet transfer path 303*a* extends up to a normal unit sheet-stack forming device 400*a*. An optical, for example, detector 314 is provided on the sheet take-in side of the unit sheet-stack forming device 400*a*. The soiled sheet transfer path 303*b* likewise extends up to the soiled unit sheet-stack forming device 400*b* and an optical, for example, detector 315 is installed at the sheet taken-in port side of the unit sheet-stack forming device 400*b*. The detectors 314 and 315 detect the number of the sheets P transferred into the unit sheet-stack forming devices 400*a* and 400*b* and the timing of the sheet transfer. The detail of those unit sheet-stack forming devices will subsequently be described referring to FIG. 3.

Figure 14A:
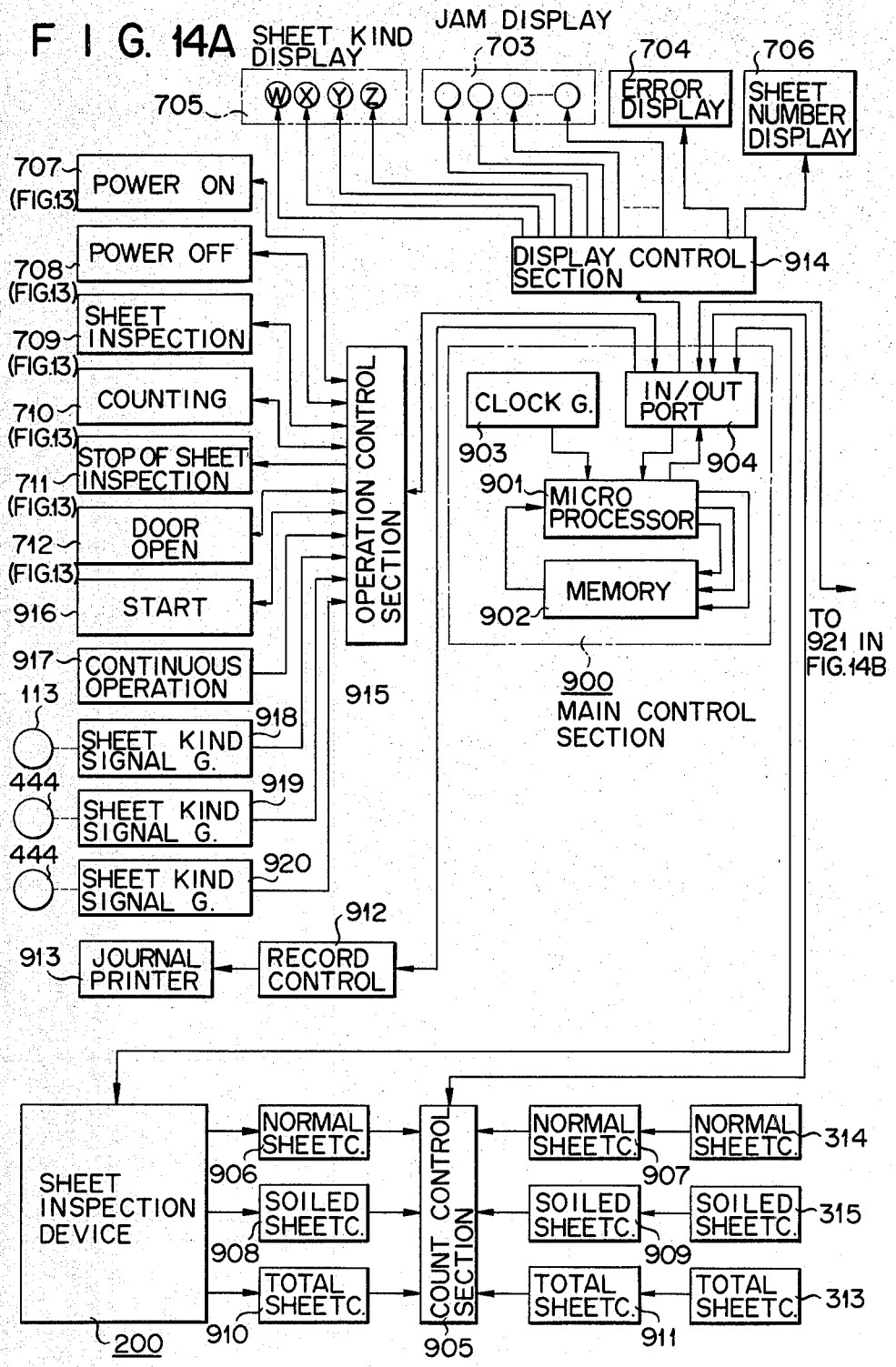
FIGS. 14A and 14B cooperate to form a block diagram of a control device for the apparatus shown in FIG. 1.
Figure 14B:
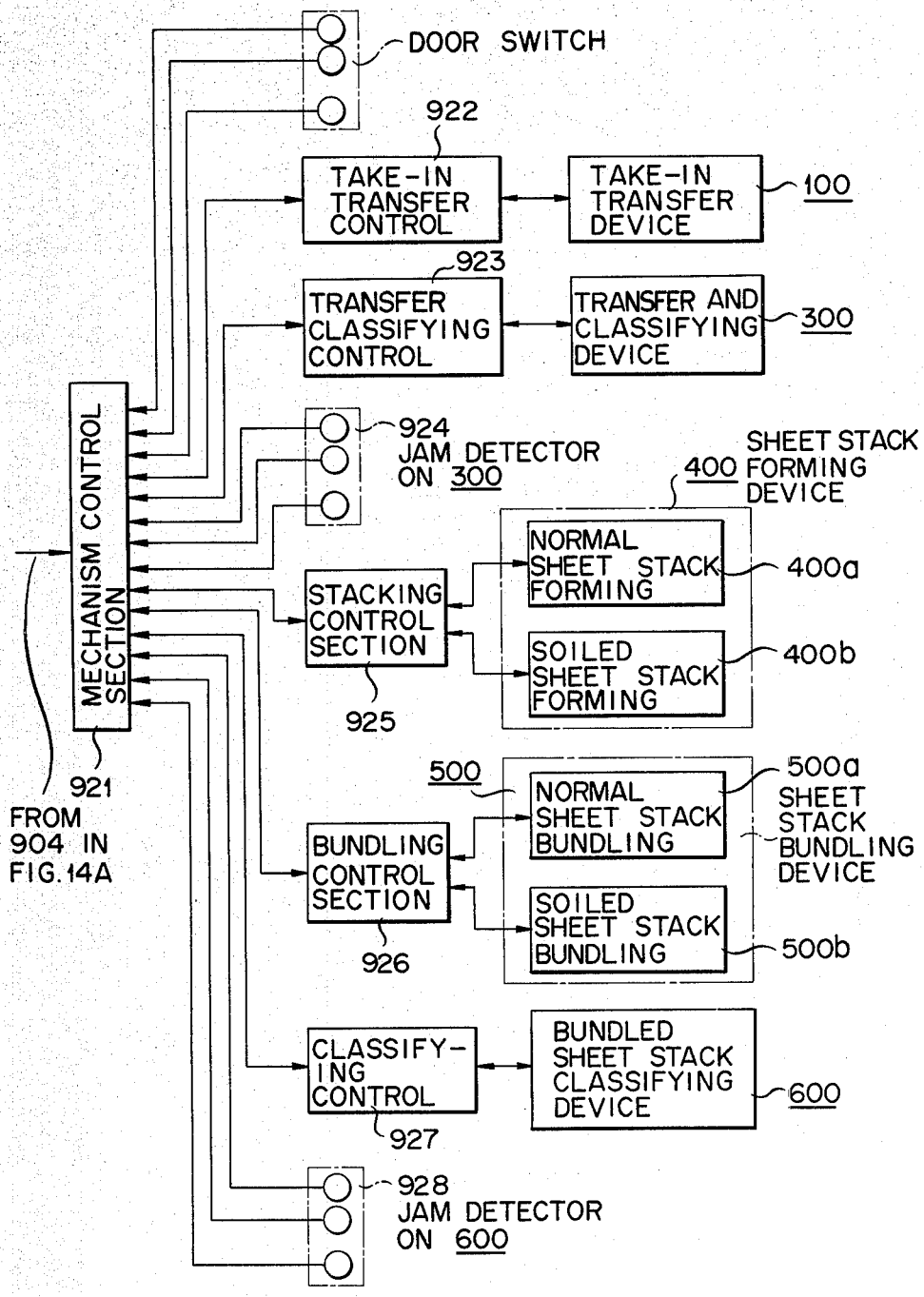

The operation of the sheet transfer and classifying device 300 will now be described in detail. The sheet P taken out by the sheet take-out/transfer device 100 is transferred to the transfer classifying device 300, through the sheet receiving section 103. Specifically, the sheet P is transferred from the sheet receiving section 103 to the first sheet transfer path 301. During the time period that the sheet travels on the first sheet transfer path, the sheet P is inspected by the inspection device 200 and the judging result or decision signal 223*a* (FIG. 2) corresponding to the class of the sheet P is produced from the decision circuit 223 (FIG. 2). The decision signal 223*a* is transferred to a control device (FIGS. 14A and 14B) to be described later. As the sheet P transferred is detected by the detector 307, the signal from the detector is applied to the control device (FIG. 14). Upon receipt of the decision signal 223*a* from the decision or judging circuit 223 (FIG. 2), the control device causes the first classifying gate 306 to swing. The first classifying gate 306, so set as to guide the sheet P to the third transfer path 303, holds the state set when the decision signal 223*a* from the decision circuit 223 represents a normal or a soiled sheet, and swings so as to guide a rejected sheet P to the second transfer path 302 when the decision signal 223*a* represents a rejected sheet at the timing that the sheet P is detected. The sheet P guided to the second transfer path 302 is accommodated in the sheet pile-up box 310 of the rejected sheet stacking section 308. The sheets P stacked or piled up in the box 310 may be taken out to exterior by opening the door 311.

When the sheet P is guided to the third transfer path 303 and detected by the detector 313, a detecting signal is produced by the detector and is transferred to the control device (FIGS. 14A and 14B). The control device causes the second classifying gate 312 to swing in response to the decision signal 223*a* from the decision circuit 223. Specifically, the second classifying gate is set in a normal condition so as to guide the sheet P to the normal sheet transfer path 303*a*. When the decision signal 223*a* represents a normal sheet, such a set condition is held as it is. When the decision signal 223*a* represents a soiled sheet, the second gate is rotated so as to guide the sheet P at the timing of the detection of the sheet P.

Though not illustrated, optical jam detectors are provided with given intervals in the transfer/classifying device 300. The jam detectors detect the presence or absence of the passing sheet P thereby to check jam and the drop-out of the sheet from the sheet transfer path.

UNIT SHEET-STACK FORMING

The unit sheet-stack forming device 400 includes the normal unit sheet-stack forming device 400*a*, and the soiled unit sheet-stack forming device 400*b*, as mentioned above. Since both the devices have the same constructions, only the normal unit sheet-stack forming device 400*a* will be described hereinafter.

Figure 3:
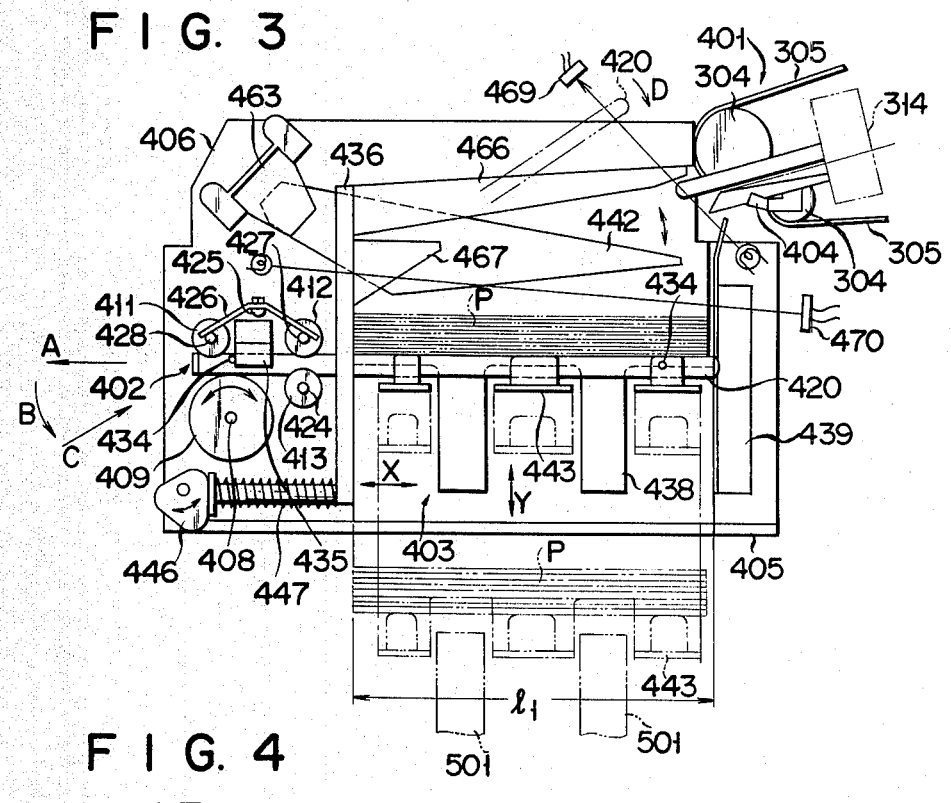
Figure 4:
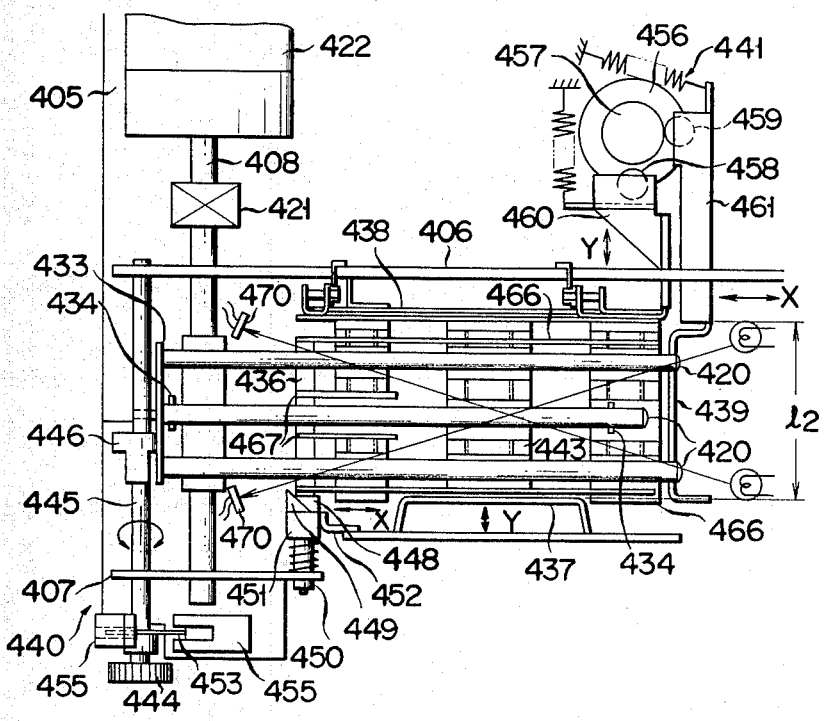

The normal unit sheet-stack forming device 400*a* is illustrated in FIGS. 3, 4, 5 and 6 which are a front view, a plan view, a side view and a part of the front view, respectively. The device 400*a* are roughly divided into a sheet take-in section 401, a separator 402, and a stack forming section 403 (FIG. 3). The sheet taken-in section 401 is comprised of a detector 314 for detecting the sheet P transferred from the normal sheet transfer path 303*a* (FIG. 1), a roller 304 for transferring the sheet P, a transfer belt 305 wound around the roller, and a charge remover 404 for removing the charge charged on the sheet P through the slide of it along the sheet P. The detector 314 detects the passing of the sheet P to detect the number of the sheets passed and the timing of the transferring sheet taken in. The roller 304 and the transfer belt 305 constitute a part of the normal sheet transfer path 303*a*. The normal unit sheet-stack forming device 400*a* is supported by subplates 406 and 407 upstanding from a base member 405. The separator 402 is comprised of a drive roller 409 mounted to a shaft 408 supported by the subplates 406 and 407 (FIG. 4), follower rollers 411 to 419 (FIG. 5) supported by brackets 410 and 410 (FIG. 5), three separator arms 420 (FIG. 4) nipped by the drive roller 409 and the follower rollers 411 to 419. The shaft 408 is rotatably coupled with a motor 422 (FIG. 4) through a coupling 421 (FIG. 4). Grooves 423 (FIG. 5) for stably supporting the separator arms 420 are formed on the peripheral surface of the drive roller 409. Similarly, grooves are formed on the peripheral surfaces of the follower rollers 411 to 419.

Figure 5:
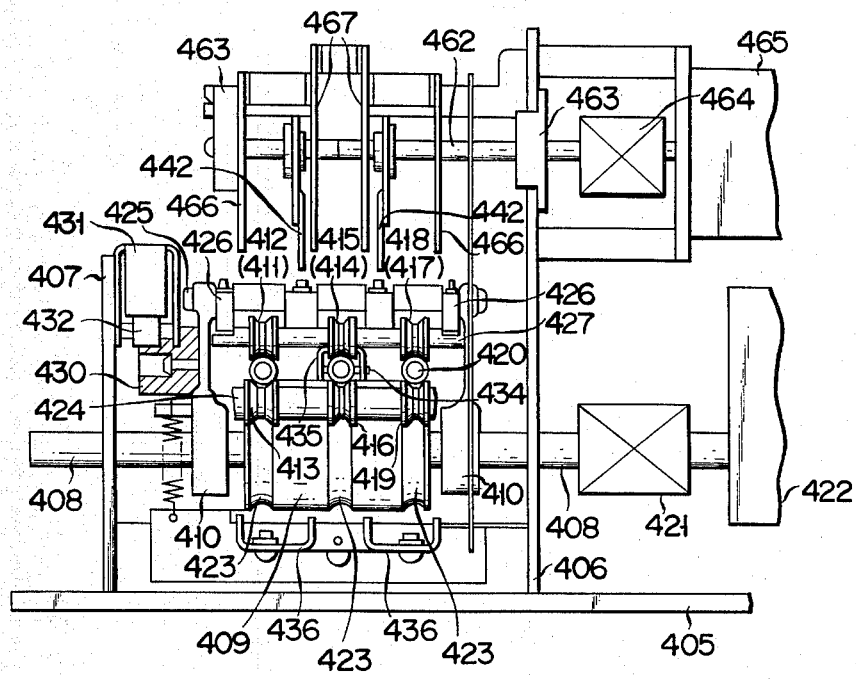
Figure 6:
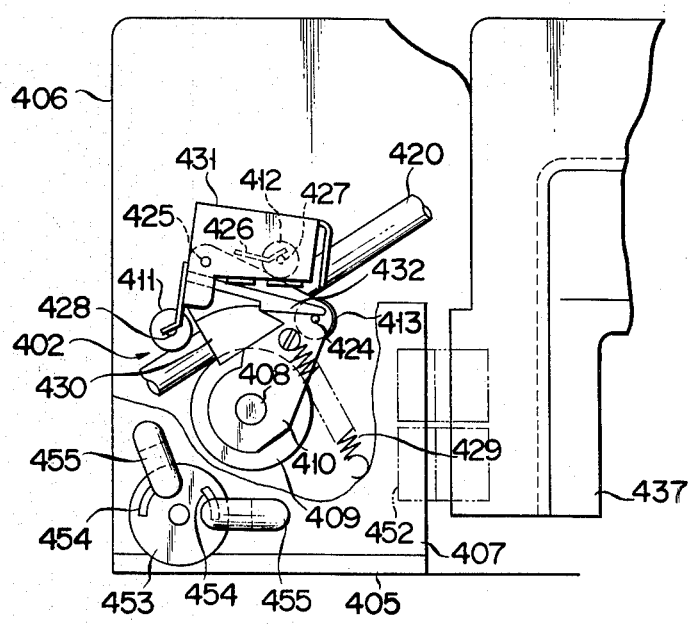

The brackets 410 and 410 (FIG. 5) are supported by the shaft 408, allowing the brackets to be rotatable about the shaft 408. A shaft 424 (FIG. 5) is bridged between the brackets 410 and 410 and rotatably supports the follower rollers 413. Above the shaft 424 (FIG. 5) a shaft 425 is bridged between the brackets 410 and 410. Four curved plate springs 426 (FIG. 5) are rotatably mounted to the shaft 425. Shafts 427 and 428 (FIG. 6) are fixed to both ends of each plate spring 426. The follower rollers 412, 415 and 418 are rotatably mounted to the shaft 427 and the follower rollers 411, 414 and 417, to the shaft 428. Thus, the brackets 410, 410 and the plate springs 416, 426, . . . are rotatable and therefore the follower rollers 411, 412, 414, 415, 417 and 418 are swingable with respect to the drive roller 409, and the follower rollers 413, 416 and 419. The brackets 410 are normally biased toward the base member 405 by means of a coiled spring 429 (FIG. 6). Further, to the brackets 410, a pawl 430 (FIG. 6) is screwd. The pawl 430 engages an armature 432 which is moved by the attraction or the release by the solenoid 431 (FIG. 6), when the brackets 410 are rotated counterclockwise against the tension of the spring 429.

The separate arms 420 (FIGS. 5 and 6) as metal bars has one end curved and the other end fixed to the plate 433 (FIG. 4). Of those three separate arms 420, the central arm 420 is provided at the forward and backward ends with stopper pins 434 and 434 as well illustrated in FIGS. 3 and 4. The stopper pins 434 defines the movable range of the separator arms 420. The stopper pins 434 are fixed by means of fixing members 435 (FIG. 5).

Included in the unit sheet-stack forming section 403 (FIG. 3) are: slide stoppers 436 as the respective side walls, a door 437 (FIG. 4), a first vibrating plate 438, a second vibrating plate 439, a mechanism 440 (FIG. 4) for changing a sheet stacking capacity by moving the slide stopper 436 and the door 437, a vibrating mechanism 441 (FIG. 4) for vibrating the first and second vibrating plates 438 and 439, beating members 442 and 442, and a back-up member or back-up plate 443 (FIG. 3) serving as the bottom, and the like. The mechanism 440 for changing the sheet stacking capacity (FIG. 4) changes the sheet stacking capacity in accordance with the size of the sheet P to be processed. When the sheet to be processed is set to a given size by rotating a knob 444 (FIG. 4 or 14), a cam 446 fixed to the shaft 445 (FIG. 4) coupled with the knob 444 rotates, so that the slide stopper 436 moves through a moving member 447 in an X direction arrowed (FIG. 4), thereby to obtain a given length $l_1$ (FIG. 3) in the longitudinal direction (longer side) of the sheet P. Also when the slide stopper 436 moves, a cam 448 fixed to the stopper 436 is also moved in the arrowed X direction (FIG. 4). With the movement of the cam 448, a cam follower 449 moves in an arrowed Y direction (FIG. 4). The cam follower 449 is fixed to a block 451 which slides along the shaft 450. The block 451 is coupled with the door 437, through a hinge 452. Therefore, the door 437 (FIG. 4) moves in the Y direction with the movement of the cam follower 449, thereby to obtain a given length $l_2$ in the shorter side (width) direction of the sheet P.

Fixed to the shaft 445, is a disc 453 for detecting the size set of the sheet, as denoted by 453 (FIGS. 4 and 6). The disc 453 has slits 454 (FIG. 6) on the peripheral surface. Those slits 454 are detected by detectors 455 disposed around the disc 453, optically. The respective output signals from the detectors 455 are transferred to the control device shown in FIGS. 14A and 14B whereby the size of the sheet P, as set, is detected.

The vibrating mechanism 441 (FIG. 4) vibrates the first and second vibrating plates 438 and 439 to arrange the stacked sheets properly. To be more specific, the motor 456 (FIG. 4) rotates an eccentric cam 457 which in turn drive cam followers 458 and 459, so that the coupling members 460 and 461 fixed to the cam followers 458 and 459 are swung in the arrows X and Y. The first vibrating plate 348 and the second vibrating plate 439 are coupled with the coupling members 460 and 461, respectively. Accordingly, the first vibrating plate 438 vibrates in the Y direction with the swing of the coupling member 460 and the second vibrating plate 439 vibrates in the X direction with the swing of the coupling member 561.

The beating plates 442 and 442 (FIG. 3), fixed to the shaft 462 (FIG. 5), are used to slap the sheet P incoming through the transfer section 401 to let it fall. The shaft 462 is supported by housings 463 and coupled with a rotary solenoid 456 through a coupling member 464. The beating members 442 and 442 are swung with a given stroke by means of the solenoid (FIG. 5). Reference numerals 466 and 466, and 467 and 467 are guide members for guiding the incoming sheet P, which are fixed to the upper end of the slide stopper 436. The slide stopper 436 and the beating members 442 and 442 are coupled in a telescopic manner between the housings 463 and 463 (FIG. 5). The guide members 466, 466, 467 and 467 are moved in the X direction (FIG. 4) with the movement of the slide stopper 436 (FIG. 5). The back-up member or the back-up plate 443 are shaped like an inverse L. The horizontal portion of the inverse L is divided into three. The back-up plate 443, disposed under the separator 402 (FIG. 3), piles up thereon the sheets P and is movable up and down, if necessary.

The operation of the normal unit sheet-stack forming device **400*a* thus far described in detail relating to its construction will be given. The sheet P coming in through the sheet take-in port is successively guided by the guide members 466, 466, 467 and 467, and is beaten to drop by the beating members 442 and 442, so that those sheets P are piled up on the separator 402 disposed within the unit sheet-stack forming section 403, successively. When the sheets P approximate to the given number are piled up on the separator 402, the separator 402 retards in an arrowed direction A (FIG. 3). Specifically, the motor 422 (FIG. 4) operates to rotate the drive roller 409, so that the separator arms 420, 420 and 420 (FIG. 3) move to the left (in the arrowed direction A in FIG. 3). After the separator 402 retards, the sheets P piled up in the separator are droped due to their own weights on the back-up plate 443 which has been lifted to a position indicated by a continuous line and ready for receiving the falling sheets. At this time, the separator 402, which retarded in the arrowed direction A, swings counterclockwise i.e. in the arrow direction B, to change its angle. Afterwards, it advances in the arrow direction C and retards to a position (FIG. 3) indicated by a two-dot chain line and is on stand-by. That is, when the separator arms 420, 420 and 420 (FIG. 4) move in the arrow direction A and the stopper pin 434 provided at the end comes in contact with the engaging member 435, the separator arms 420, 420, 420 and 420 swing in the arrow direction B. The swing is stopped to be locked when the pawl 430 (FIG. 6) engages the armature 432. Upon the locking those separator arms 420, the drive roller 409 rotates, so that the separator arms 420, 420, 420 and 420 move in the arrow direction C. Then, when the stopper pin 434 comes to engage the engaging member 435, the drive roller 409** stops its rotation.

In this way, when the sheets P approximate to the given number (, for example, 100) are piled up on the back-up member 443, the back-up member 443 descends to the position (FIG. 3) indicated by one-dot chain line. Then, when the given number of sheets P is stacked on the back-up plate 443, the separator 402, which has been on stand-by above the unit sheet-stack forming section 403, rotates clockwise, i.e. in the arrow direction D to stop again at the position indicated by a continuous line. Specifically, when the 100th sheet P is detected by the detector 314, the control device shown in FIGS. 14A and 14B receives a detecting signal from the detector 314 to apply a drive signal to the solenoid 431 (FIG. 5), so that the engagement of the armature 432 with the pawl 430 is released. Therefore, the separator arms 420, 420 and 420 are unlocked and the tension of the spring 429 (FIG. 6) causes the separator arms to drop (rotate). Accordingly, the sheet P on the back-up plate 443 is perfectly separated from the successively transferred sheets P, by means of the separator 402. The number of the sheets P stacked on the back-up plate 443 is counted by the control device shown in FIGS. 14A and 14B on the basis of the output signal from the detector 314. Whether those sheets P are separated into the given number of them or not is optically checked by the detectors 469, 470 and 470 (FIGS. 3 and 4). In other words, when the detector 469 detects the 101st sheet P, if the detectors 470 and 470 (FIG. 4) have been changed from "dark" to "bright", it is assumed that the sheets P have been separated with an accuracy of the given number of sheets. The back-up plate 443 descends from the position indicated by the one-dot chain line to the position (FIG. 3) by the two-dot chain line, while bearing the given number of the stacked sheets P. The sheet stack will be called a unit sheet-stack. Then the unit sheet-stack is transferred to rotatable drums 501 and 501 (FIG. 7) of the unit sheet-stack bundling device 500 (FIG. 1). After the transfer of the unit sheet-stack, the back-up plate 443 ascends again up to the position indicated by the continuous line (FIG. 3).

UNIT SHEET-STACK BUNDLING

As described above, the unit sheet-stack bundling device 500 includes a normal unit sheet-stack bundling device 500*a* and the soiled unit sheet-stack bundling device 500*b*. Since both the devices have the same constructions, the description will be given only about the normal unit sheet-stack device 500*a*.

Figure 7:
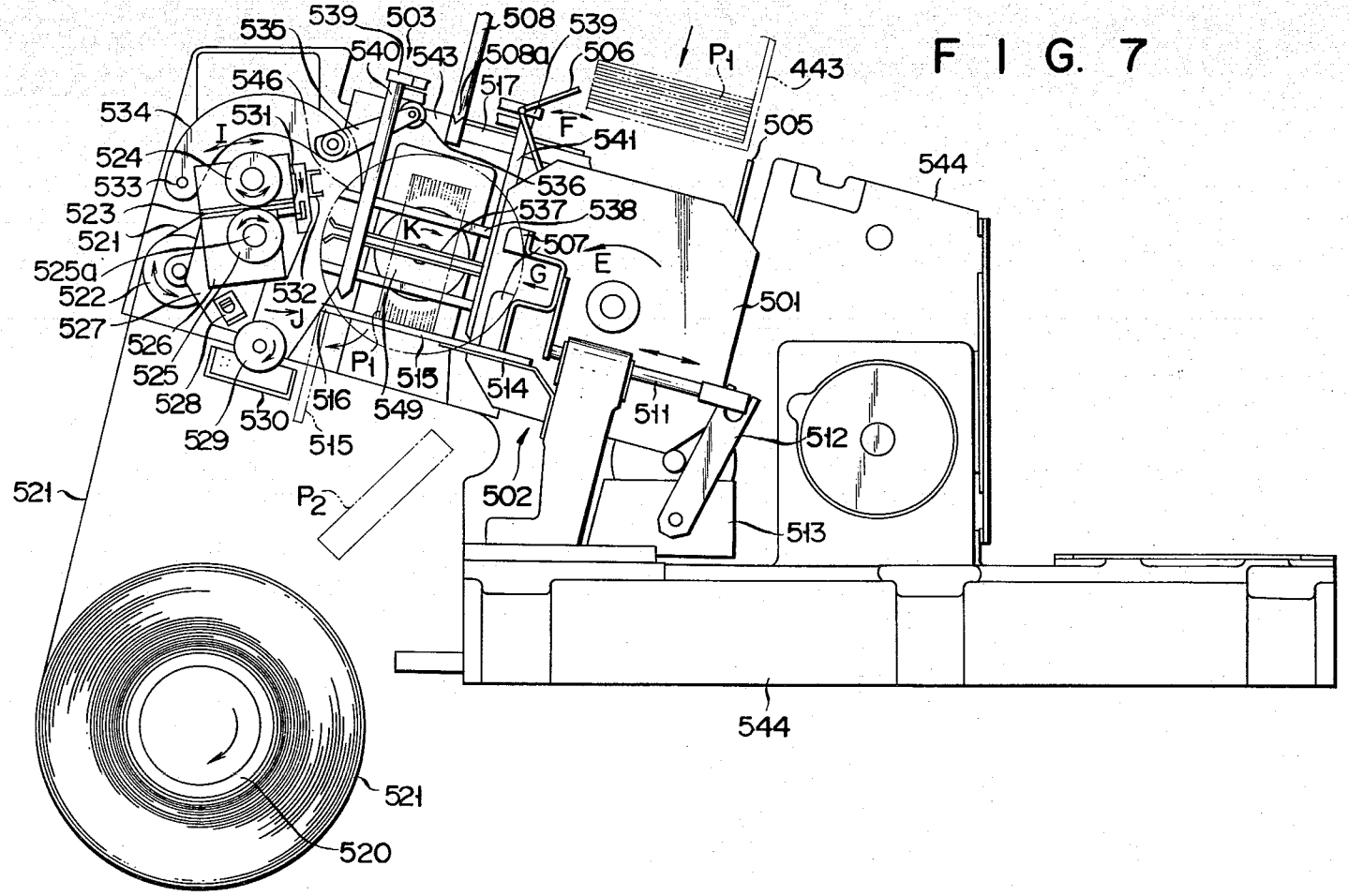
Figure 8:
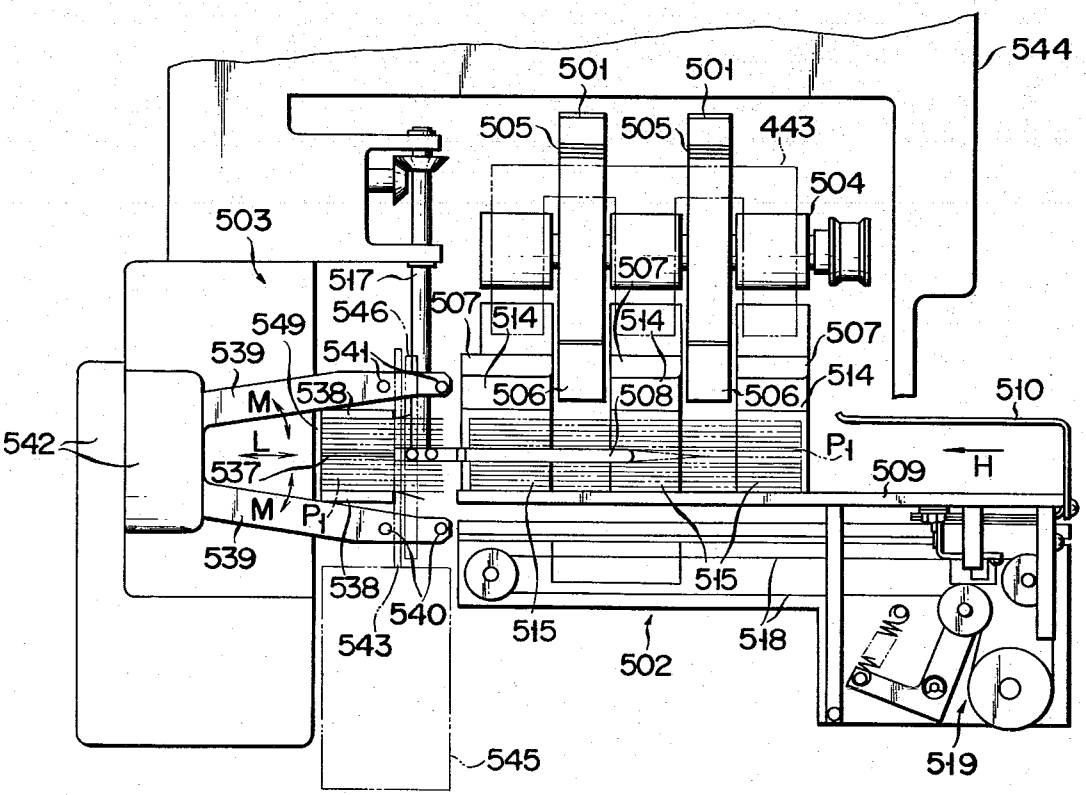

The normal unit sheet-stack bundling device 500*a* shown in FIGS. 7 and 8 comprises a transfer mechanism for transferring the unit sheet-stack to a given position, a bundling loop forming mechanism for forming a bundling tape loop for bundling the unit sheet-stack, and a bundling mechanism for inserting the unit sheet-stack into the loop and bundling the unit sheet-stack. The transfer mechanism includes a pair of the rotatory drums 501 and 501. The bundling loop forming mechanism, the bundling mechanism 503 and an inserting mechanism 502 for inserting the unit sheet-stack into the loop are illustrated in FIG. 7. The rotatory drums 501 and 501, disposed under the back-up plate 443 of the normal unit sheet-stack forming device, receives the given number of sheets P transferred in a substantially horizontal state by the back-up member 443, the unit sheet-stack P1, and rotates the unit sheet-stack counter-clock, i.e. in the arrow direction E by approximately 90° thereby to set the unit sheet-stack, i.e. the respective sheets, in substantially vertical state. Specifically, the respective rotatory drums 501 and 501 are so designed that those are shaped substantially square with a given thickness and are mounted to a shaft 504 (FIG. 8) at given intervals. When the shaft 504 is rotated by a drive source (not shown), the drums are rotated in the arrow direction E. Fixing plates 505 and inverse L shaped movable holding plates, or clamp members 506, upstand on the peripheral surfaces of the drums 501 and 501. The clamp members 506, so designed as to open and close in the arrow direction F, opens when the unit sheet-stack P1 is to be received, and closes when the unit sheet-stack P1 is received, whereby the unit sheet-stack P1 is clamped in the stacking direction by means of the fixing plate 505 and the clamp member 506. The rotatory drums 501 and 501 are coupled with the horizontal section of the back-up member 443 in a telescopic manner, when the back-up member 443 descends from the unit sheet-stack forming device 400*a*.

The unit sheet-stack shift mechanism 502 divides the unit sheet-stack P1 disposed by the rotatory drums 501 and 501 into first and second sub-unit sheet-stacks at the central portion of the unit sheet-stack as viewed in the stacking direction. Then, the mechanism transfers or shifts the divided ones to the bundling tape loop forming/bundling mechanism. The unit sheet-stack shift mechanism 502 is comprised of a pushing member 507, a dividing plate 508, a guide wall 509, and a feed arm 510. The pushing member 507 is coupled with the drive section 513, through a push bar 511 and an arm 512. When the drive section 513 is operated, the pushing member 507 moves in the arrow direction G (FIG. 7), through the arm 512 and the push bar 511. The pushing member 507 pushes the unit sheet-stack P1 substantially vertically clamped on the drums 501 and 501 along the fixed bottom plate 514 and the movable bottom plate 515 till the stack reaches the guide wall 509. The pushing member 507, the fixed bottom plate 514, and the movable bottom plate 515 are divided into three and, of those, the pushing member 507 and the fixing bottom plate 514 are telescoped with the rotatory drums 501 and 501 (FIG. 8).

The bundling loop forming/bundling mechanism 503 turns the free end portion of the bundling tape fed from the bundling tape supply source by a given number of turns thereby to form a bundling tape loop. Within the loop, the free end of the tape is suspended so as to divide the space within the loop into two sections. Into the bundling loop, the unit sheet-stack P1 is inserted by means of the unit sheet-stack shift mechanism 502 thereby to push up the loop to bundle the unit sheet-stack. The bundling loop forming/bundling mechanism 503 is provided on the left end portion (FIG. 8) of the sheet-stack shifting mechanism 502. The bundling tape wound around a reel 520 (FIG. 7) of the tape supplier, for example, a green paper tape 521 (a yellow paper tape is used for the soiled unit sheet-stack bundling) is led to a tape guide path 523 through a tape guide roller 522. In the middle way of the guide path 523, the paper tape 521 is nipped by a pair of tape feeding rollers 524 and 525 and is fed forward. The guide path 523 and the feeding rollers 524 and 525 are provided on a roller supporting member 526. The roller supporting member 526 rotates in the arrow direction I about the shaft 525*a* of the feeding roller 525, if necessary.

On the forward portion of the roller supporting member 526, or on the right side in FIG. 7, a tape guide member 537 is provided into which the leading end of the tape 521 fed by the feeding rollers 524 and 525 is inserted by a given length thereof. A pair of unit sheet-stack guides 538 and 538 provided in parallel on both sides of the guide member 537 are used for guiding the unit sheet-stack P1 transferred by the transfer arm 510 (FIG. 8). These guide members 537, 538 and 538 are fixed to a guide member drive disc 549 and are rotated in the arrow direction K or moved in the arrow direction L as required by means of the disc 549. A pair of clamp drive arms 539 and 539 are disposed above the guide members 537 and 538 (FIG. 8). At the ends of those arms 539 and 539, pairs of clamp bars 540, 540, 541 and 541 are suspended in parallel at given intervals. The arms 539 and 539, coupled at the rear ends or the left ends in FIG. 8, with the drive section 542, are opened and closed in the arrow direction M by means of the drive section 542, if necessary. At the time closing, the unit sheet-stack P1 transferred by the feeding arm 510 (FIG. 8) is clamped by the pairs of the clamp bars 540 and 540, and 541 and 541.

In FIGS. 7 and 8, reference numeral 543 designates a tape insertion preventive plate shaped like an inverse U. The preventive plate 543 is provided at the portion corresponding to the ends of the sheet guide members 538 and 538, substantially upright. Reference numeral 544 in FIGS. 7 and 8 indicates a base member of the apparatus. A portion 545 enclosed by a two-dot chain line indicates a portion where the respective components 521 to 536 in FIG. 7 are located.

Figure 9A:
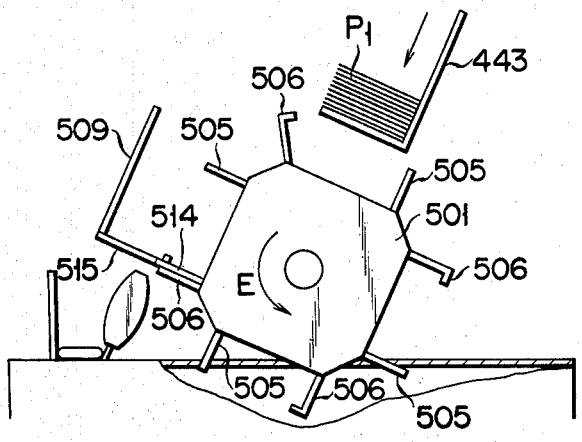
FIGS. 9A to 9F illustrate a revolving drum used in the bundling device in FIGS. 7 and 8 and its peripheral structure.
Figure 9B:
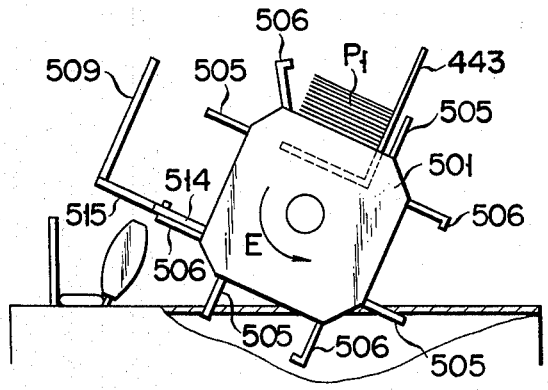
Figure 9C:
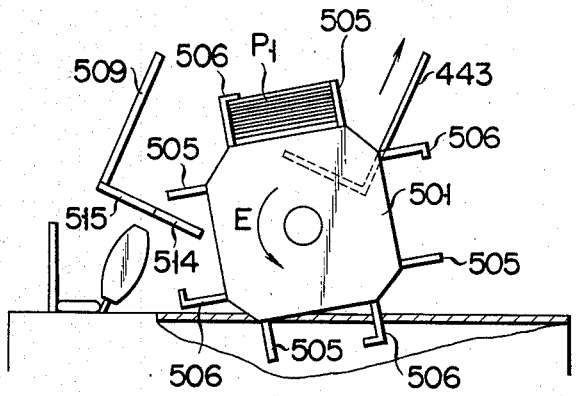
Figure 9D:
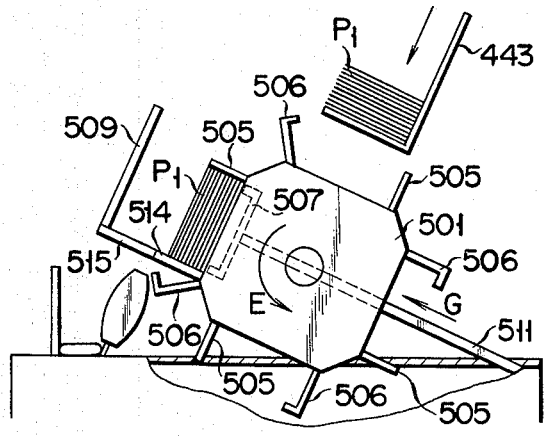
Figure 9E:
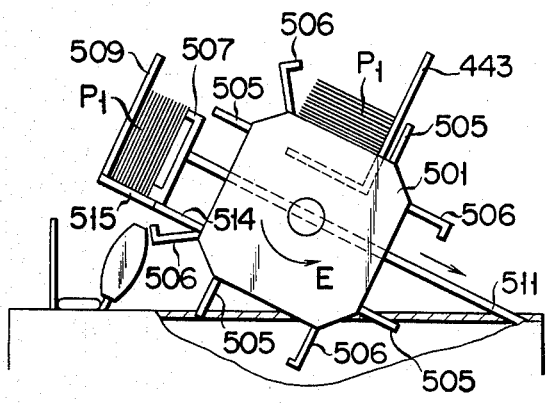

The operation of the normal unit sheet-stack bundling device 500*a* will be described referring to FIGS. 9A to 9F, and FIGS. 10A to 10I. The rotatory drums 501 and 501 are normally at a standstill in a state shown in FIG. 9A, waiting the receiving of the unit sheet-stack P1. At this time, the clamp members 506 are in a closed condition. Under this condition, if the back-up member 443 bearing the unit sheet-stack (including 100 sheets stacked, for example) descends, the clamp member 506 corresponding to the back-up member 443 opens for receiving the sheet-stack, as shown in FIG. 9A. The back-up member 443 further descends and temporarily stops when the horizontal portion of the back-up member 443 is telescoped with the rotatory drums 501 and 501, as shown in FIG. 9B. In this way, the unit sheet-stack P1 on the back-up member 443 is transferred onto the peripheral surfaces of the rotatory drums 501 and 501. When the unit sheet-stack P1 is transferred to the rotatory drum 501, the clamp member 506 is closed as shown in FIG. 9C to clamp the unit sheet-stack P1 and the drums 501 and 501 start to rotate in the arrow direction E, while at the same time the back-up member 443 ascends. When the rotatory drums 501 and 501 are rotated by about 90 degrees clockwise, as shown in FIG. 9D, the rotatory drums 501 and 501 temporarily stop thereat and the clamp member 506 opens again. At this time, the lower end surface of the unit sheet-stack P1 is directed substantially horizontally with respect to the fixed bottom plate 514, as shown in FIG. 9D. And the unit sheet-stack P1 is transferred onto the bottom plate 514, with the sheets being disposed substantially vertically. In this way, the unit sheet-stack P1 received from the back-up member 443 while being substantially in horizontal state is rotated by about 90° in the arrow direction E to be postured substantially vertically. In this way, the rotatory drums 501 and 501 stop the rotation and the clamp member 506 opens. Succeedingly, the drive section 513 (FIG. 7) operates with the result that the pushing member 507 advances in the arrow direction G, as shown in FIG. 9D to push the unit sheet-stack on the fixed bottom plate 514 to come in contact with the guide wall 509, as shown in FIG. 9E. At this position, the pushing member 507 temporarily stops. Accordingly, the pushed unit sheet-stack P1 is positioned on the movable bottom plate 515 in the substantial vertical posture, as shown in FIG. 8.

Then, when the back-up member 443 carrying the next unit sheet-stack P1 descends again, the unit sheet-stack is transferred to another peripheral surface of the rotatory drums 501 and 501, through the above-mentioned operation, as shown in FIGS. 9D and 9E.

Figure 10A:
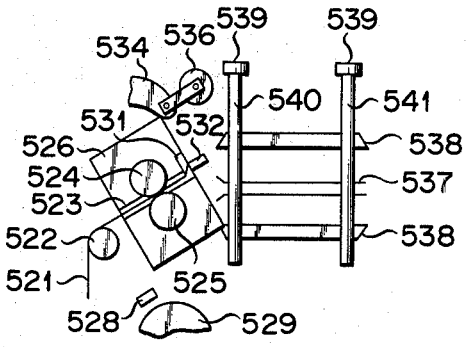
FIGS. 10A to 10I illustrate a bundling tape loop forming mechanism (FIGS. 10A to 10C) and a unit sheet-stack bundling mechanism (FIGS. 10D to 10I)
Figure 10B:
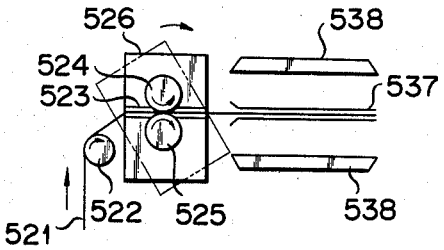
Figure 10C:
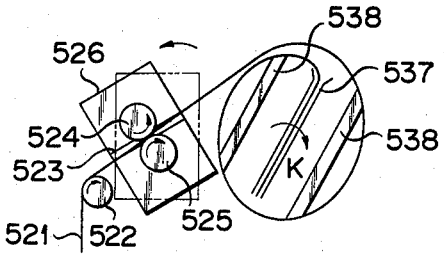
Figure 10D:
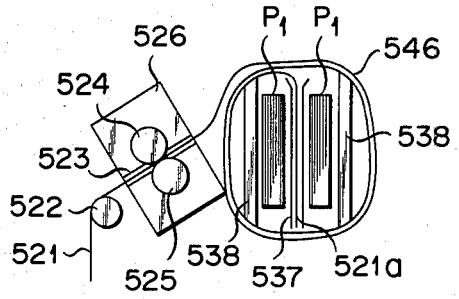

When the pushing member 507 temporarily stops as shown in FIG. 9E (or when the pushing member 507 starts to advance), the bundling loop forming/bundling mechanism (FIG. 8) 503 starts the bundling loop formation. The construction and operation of the bundling loop forming/bundling mechanism 503 will now be described. In FIGS. 7, 8 and 10A, a roller receiving member 526, a paste pad 528, a squeeze roller 536, a tape guide member 537, unit sheet-stack guide members 538 and 538, and clamp bars 540, 540, 541 and 541 are stopped in the state shown in FIG. 10A, or in the state of FIGS. 7 and 8, and is ready for the start of the operation. Under this condition, when the bundling loop formation command is issued, the roller receiving member 526 rotates clockwise as shown in FIG. 10B and the outlet (end) of the guide path 523 temporarily stops at the position facing the inlet of the tape guide member 537. When the roller receiving member 526 stops, the feeding rollers 524 and 525 rotate in the tape feeding direction, so that the tape 521 is fed and the leading end portion of the tape is inserted into the guide member 537 by the given length, as shown in FIG. 10B. When the leading end portion of the tape is inserted into the tape guide member 537, the receiving member 526 rotates counterclockwise, as shown in FIG. 10C to return to the original position (FIG. 10A), and the feeding rollers 524 and 525 rotate again to feed the tape 521. At this time, the disc 549 (FIG. 7) rotates in the arrow direction K while at the same time the tape guide member 537 and the unit sheet-stack guides 538 and 538 rotate, as shown in FIG. 10C. The rotation is $2\times\frac{1}{4}$ turns, for example. Then, when the guide members 537, 538 and 538 are postured substantially vertically as shown in FIG. 10D, the rotation and the tape 521 feeding are stopped. As described above, one end of the tape 521 fed by the feeding rollers 524 and 525 is wound by about two turns, as shown in FIG. 10D and the leading end portion 521*a* of the tape is suspended in the space defined by the loop so as to divide the space into two sections. After the tape loop is thus previously formed, the loop waits the unit sheet-stack P1 fed by the arm 510. The bundling loop 546 is formed on the right side portion of the tape insertion preventive plate 543, as shown in FIG. 8.

Figure 9F:
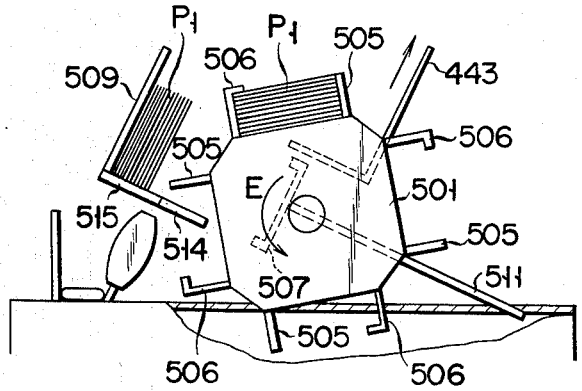

Once the bundling loop 546 is formed, the dividing plate 508 (FIG. 8) swings about the fulcrum of the shaft 517 downwardly. At this time, the dividing plate is inserted into the center of the thickness of the unit sheet-stack P1 substantially vertically postured on the movable bottom plate 515 (FIG. 8), so that the unit sheet-stack P1 is divided into two sub-unit sections by the dividing plate 508. When the stack is divided, the pushing member 507 retracts by a distance corresponding to the thickness of the dividing plate 508 thereby to facilitate the insertion of the dividing plate 508 to the unit sheet-stack P1. The dividing plate 508 temporarily stops, being inserted within the unit sheet-stack P1. In this way, when the dividing plate 508 stops within the unit sheet-stack P1, the feeding arm 510 (FIG. 8) advances in the arrow direction H and feeds the unit sheet-stack P1 divided on the movable bottom plate 515, while holding it, along the guide wall 509 in the arrow direction H. At this time, the pushing member 507 retracts (moves to the right in FIG. 7), as shown in FIG. 9F to return to the original position to stop thereat. At this time, the rotatory drums 501 and 501 close the clamp member 506 to clamp the next unit sheet-stack and to rotate by 90° and repeats the above-mentioned operation. In this way, the divided unit sheet-stack P1 fed by the feeding arm 510 (FIG. 8) is guided by the unit sheet-stack guide members 538 and 538 and are stopped at the position where it is inserted into the bundling loop 546, as shown in FIGS. 8 and 10D. At this stage, the tape guide member 537 is inserted between the sub-unit sheet-stacks divided, as shown in FIG. 10D. At this time, the dividing plate 508 swings upwardly (FIG. 8) to retract from the unit sheet-stack P1 to return to the original position and stop thereat.

Figure 10E:
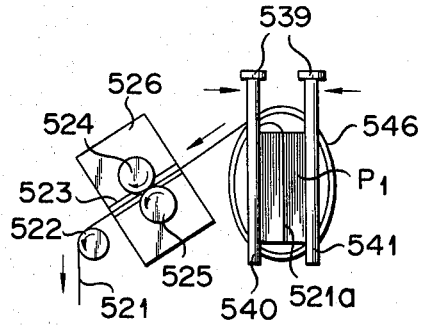
Figure 10F:
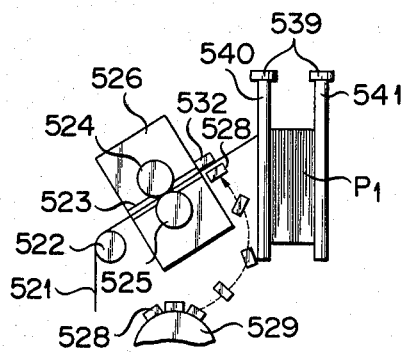

When the unit sheet-stack P1 is inserted at the leading end into the bundling loop 546, and the dividing plate 508 returns to the original position, the tape guide member 537 and the unit sheet-stack guide members 538 and 538 retracts (moves to the left in FIG. 8), together with the disc 549, and goes into the drive section 542 in FIG. 8. At this time, the tape pull-in preventive plate 543 (FIG. 8) prevents the bundling loop 546, as well as the guide members 537, 538 and 538, from being pulled in. The free end 521*a* of the tape suspended in the inner space of the bundling loop 546 is positioned between the first and second sub-unit sheet-stacks divided. When the respective guide members 537, 538 and 538 retard, the drive arms 539 and 539 perform the closing operation, so that the unit sheet-stack P1 is nipped by the clamp bars 540 and 540, and 541 and 541 to be clamped. Therefore, the leading end portion 521*a* of the tape is inserted into the unit sheet-stack P1, as shown in FIG. 10E. At this time, the feeding arm 510 (FIG. 8) retracts, or moves to the right to return to the original position and stop thereat. When the unit sheet stack P1 is clamped by the clamp bars 540 and 540, and 541 and 541, the feeding rollers 524 and 525 rotates in the reverse direction to that in which the feeding rollers 524 and 525 feed the tape, so that the tape 521 is retracted to squeeze the bundling loop 546, as shown in FIGS. 10E and 10F. Upon the completion of the squeezing of the loop, the arm 527 (FIG. 7) rotates counterclockwise and the pasting pad 528 revolves and rotates, as shown in FIG. 10F, so that the tape 521 is pasted at the pad receiving member 532. Following the pasting of the tape, the pasting pad returns to the original position.

Figure 10G:
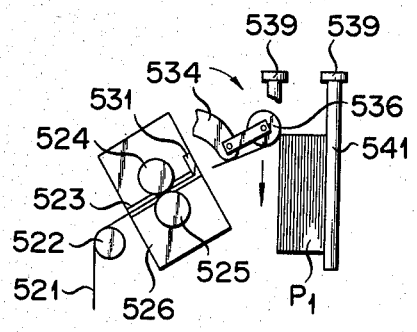
Figure 10H:
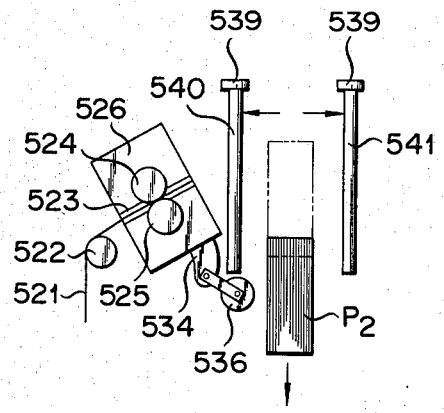
Figure 10I:
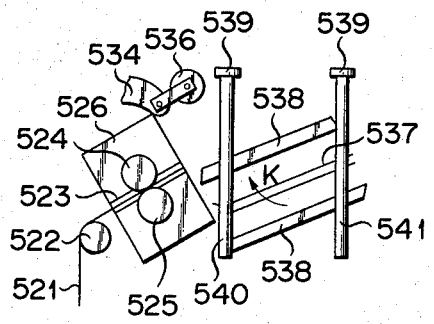

In this way, when the pasting work for the tape 521 is completed, the arm 534 rotates clockwise and the squeezing roller 536 moves, as shown in FIG. 10G, so that the roller 536 comes in contact with the corner of the unit sheet-stack to push the tape 521. At this time, the cutter 531 operates to cut the tape 521. Then, squeeze roller 536 rotates downwardly on the tape wound around the unit sheet-stack P1 with the rotation of the arm 534, while pressing the tape. Through this rotation of the squeeze roller, and end portion of the tape which is pasted and cut is fastened onto the tape wound around the unit sheet-stack P1 and forcibly presses the tape. In this way, the unit sheet-stack P2 bundled by the tape 521 is obtained. The unit sheet-stack in this state will be called a bundled unit sheet-stack P2. When the pasting and squeezing operations by the squeezing roller are completed, the movable bottom plate 515 (FIG. 7) opens, as indicated by a two-dot chain line and the arms 539 and 539 are also opened. Upon this, the clamp for the bundled unit sheet-stack by the clamp bars 540, 540, 541 and 541 is released and the bundled unit sheet-stack P2 falls naturally and is guided to the bundled unit sheet-stack classifying device 600 located under the bundling device. When the bundled unit sheet-stack P2 drops to the classifying device 500, the squeezing roller 536 returns to the original position, as shown in FIG. 10I, and the guide members 537, 538 and 538 which have been pulled in the drive portion 542 (FIG. 8) advances to return to the state shown in FIG. 8. Then, the disc 549 (FIG. 7) rotates again in the arrow direction K and the respective guide members 537, 538 and 538 also rotate, as shown in FIG. 10I and return to the original position and then prepare for the next bundling loop forming operation.

BUNDLED UNIT SHEET-STACK CLASSIFYING

Figure 11:
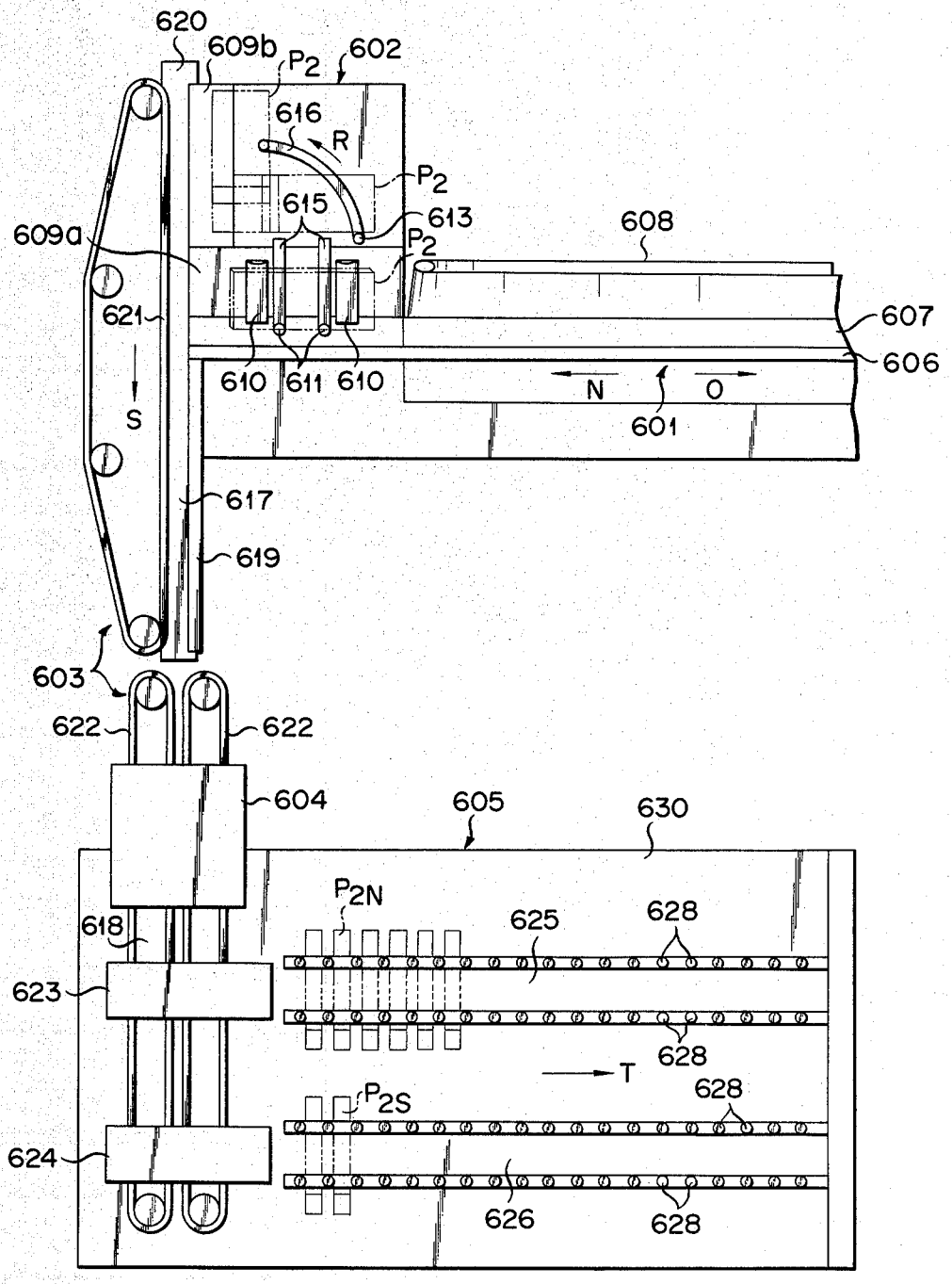
FIG. 11 is a plan view of a classifying device for classifying the bundled unit sheet-stacks.

The bundled unit sheet-stack classifying device 600, as shown in FIG. 11, comprises a bundled unit sheet-stack take-out path 601, a stamping section 602, a transfer path 603, a bundled-tape color sensor 604, and a classifying device 605. The take-out path 601 receives the bundled unit sheet-stack P2 which naturally falls thereon from the unit sheet-stack bundling device 600, and transfers the bundled sheet-stack in the arrow direction N, i.e. to the left in FIG. 1, being postured substantially vertically (in fact, being slanted by approximately 15° with respect to the vertical line). As well illustrated in FIG. 12A, the device 600 comprises a guide wall 606, a horizontal transfer belt 607, and a vertical transfer belt slanted outwardly by approximately 15°. The stamping section 602, provided at the end portion of the take-out path 601, stamps a specific stamp on the tape of the incoming bundled unit sheet-stack. The stamping section is comprised of a stamping table 609, transfer rollers 610 and 610, left arms 611 and 611, a stamper 612 and a scrape-out bar 613. The stamping table 609, disposed facing the guide wall 606, have slanted surfaces 609*a* and 609*b* on the guide wall side and the transfer path 603 side. Transfer rollers 610 and 610 receive the incoming bundled unit sheet-stack P2 and transfer it to a given position, and are disposed in parallel along the slanted surface 609*a* of the stamping table 609, substantially vertically. Lift arms 611 and 611 are used to lift the bundled unit sheet-stack transferred by the transfer rollers 610 and 610 onto the stamping table along the slanted surface 609*a*. The lift arms 611 and 611, shaped like an arc, are swung in the arrow direction Q on the fulcrum of a shaft 614 (FIG. 12B), if necessary. Those move along grooves 615 and 615 (FIG. 11) with the end portions projecting above the slanted surface 609*a*. The lift arms 611 and 611 are normally positioned within the stamping table 609. The stamper 612 is positioned above the stamping table 609 and descends onto the stamping table 609, if necessary. The scrape-out bar 613 scrapes out the bundled unit sheet-stack P2 on the stamping table 609 along the slanted surface 609*a* of the stamping table 609 onto the next transfer path 603 by rotating counterclockwise by about 90° on the fulcrum of the left end (in a state indicated by a two-dot chain line shown in FIG. 11). The scrape-out bar 613 extends to the end portion within an arc groove 616 formed on the upper surface of the stamping table 609, as required, and moves along the groove 616 in an arrow direction R.

Figure 12A:
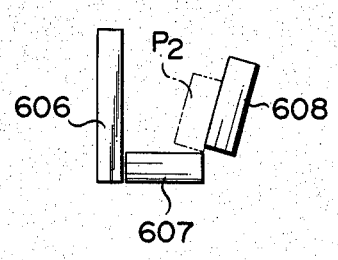
FIGS. 12A to 12C are side views of the essential parts of the construction shown in FIG. 11.
Figure 12B:
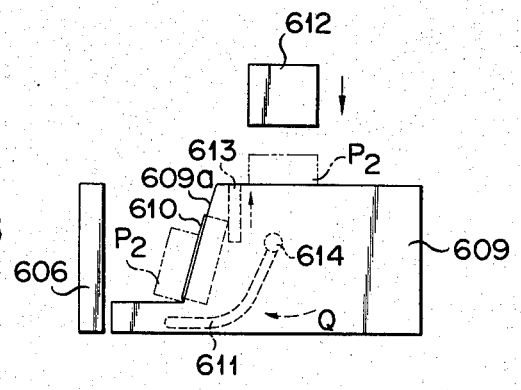
Figure 12C:
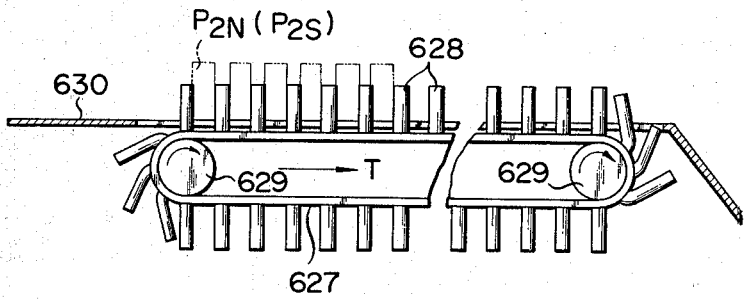

The transfer path 603 receives the bundled unit sheet-stack P2 scraped out from the stamping table 609 and transfers it in an arrow direction S (normal to the take-out direction of the take-out path 601), with the sheet-stack P2 being postured substantially vertically. The transfer path 603 is comprised of a prestage transfer path 617 and a poststage transfer path 618. The prestage transfer path 617 includes a guide wall 619, a horizontal transfer belt 620, and a vertical transfer belt 621. The poststage transfer path 618 is comprised of two vertical transfer belts 622 and 622, and transfers the bundled unit sheet-stack P2 while nipping it. The tape color sensor 604 optically, for example, senses a color of the bundled tape of the bundled unit sheet-stack transferred on the transfer path 603. The tape sensor 604 is provided on the midway of the transfer path 603, for example, the poststage transfer path 618. The bundled unit sheet-stack classifying section 605, provided at the terminal portion of the transfer path 603, classifies the incoming bundled unit sheet-stack P2 into a bundled normal unit sheet-stack P2N and bundled unit soiled sheet-stack P2S, and independently stacks those stacks. The section 605 is comprised of a classifying gate 623 for the normal unit sheet-stack P2N, a classifying gate 624 for the soiled unit sheet-stack P2S, a stack path 625 for the normal unit sheet-stack P2N, and a stack path 626 for the soiled unit sheet-stack P2S. The classifying gate 623 responds to a sensing signal (corresponding to a green color) from the sensor 604, and guides the corresponding normal unit sheet-stack P2N to the stack path 625. The classifying gate 624 responds to a signal (corresponding to yellow color) from the sensor 604 and guides the corresponding soiled unit sheet-stack P2S to the soiled stack path 626. The normal unit sheet-stack path and the soiled unit sheet-stack path 626, provided corresponding to the classifying gates 623 and 624, receive the bundled normal unit sheet-stack P2N and the bundled soiled unit sheet-stack P2S guided by the classifying gates 623 and 624, and successively transfer those stacks in the arrow direction T with the longitudinal side of the unit sheet-stack disposed horizontally. The stack paths 625 and 626, as well illustrated in FIG. 12C, is comprised of an endless belt 627, and a plurality of resilient pins 628, 628, . . . upstanding on the endless belt 627 in parallel at fixed intervals. The bundled normal unit sheet-stack P2N or the bundled soiled unit sheet-stack is clamped between the pins 628 and 628. The respective pins 628, 628, . . . are in a vertical state at the horizontal portion of the belt 627, as shown in FIG. 12C and automatically bring down at the portions where the rollers 629 and 629 are located with the belt wound therearound. Reference numeral 630 in FIG. 11 designates a base member of the bundled unit sheet-stack device 605.

The operation of the bundled unit sheet-stack classifying device 600 will be described hereinafter. At the instant the bundled unit sheet-stack P2 falls from the bundling device 500 onto the transfer path 601, the take-out path 601 temporarily moves in an arrow direction O, and then in an arrow direction N. This is made for assisting the natural falling of the bundled unit sheet-stack P2. To be more specific, when clamp bars 540, 540, 541 and 541 in the bundling device 500, clamping the bundled unit sheet-stack P2, are released (FIG. 10A), the bundled end portion (the left side end portion in FIG. 8) of the bundled unit sheet-stack P2 comes in contact with the clamp bars 540, 540, 541 and 541 or the respective guide members 537, 538 and 538, so that the bundled unit sheet-stack falls in a state that it is somewhat slanted with the end of the bundled stack being up but the other end being down. When the transfer path 601 suddenly operates in the arrow direction N, the bundled unit sheet-stack becomes in a vertical state with the shorter side (width) being horizontal, with the result that the transfer path 601 instantaneously operates in the arrow direction O, thereby to prevent it.

The bundled unit sheet-stack P2 dropped on the take-out path 601 is taken out in the substantial vertical state, of which the bundled end portion is headed and the longitudinal side is directed horizontally. When the bundled unit sheet-stack P2 reaches the stamping section 602, the sheet-stack P2 is transferred to the transfer rollers 610 and 610 and carried to a given position as indicated by a two-dot chain line in FIG. 11, and is stopped thereat. When the bundled sheet-stack P2 stops at the given position, the lift arms 611 and 611 swing in the arrow direction Q (FIG. 12A). At this time, the left arms 611 and 611 protrude the leading ends from the lower end of the slanted surface 609*a* beyond the upper end 609*a*. And those continue the swing along the grooves 615 and 615 (FIG. 11). As a result, the bundled unit sheet-stack P2 is lifted along the slanted surface 609*a* in a state that it is placed on the lift arms 611 and 611 and is transferred to the stamping table 609 as indicated by the two-dot chain line shown in FIG. 11 and FIG. 12B. When the bundled sheet-stack P2 is placed on the stamping table 609, the stamper 612 falls to press a given stamp on the tape of the bundled sheet-stack. Then, it rises to return to the original position.

Upon the completion of the stamping operation, the scrape-out bar 613 projects above the stamping table 609, and moves along the groove 616 (FIG. 11) in the arrow direction R. At this time, the scrape-out bar 613 projects to this side of the right end (the end opposite to the bundling portion) of the bundled sheet-stack P2 indicated by a two-dot chain line in FIG. 11. Accordingly, the bundled sheet-stack P2 on the stamping table 609 is rotated by about 90° on the fulcrum of the left end (FIG. 11), with the movement of the scrape-out bar 613. The sheet-stack P2 is in a state indicated by the one-dot chain line in FIG. 11. At this time, the sheet-stack P2 protrudes at the left end (the left end in the state indicated by the one-dot chain line FIG. 11) above the slanting surface 609*b*. As a result, the sheet-stack P2, upon the pushing action by the movement of the scrape-out bar 613, falls to the start end of the transfer path 603 along the slanting surface 609*b*.

The transfer path 603 transfers the bundled unit sheet-stack P2 dropped from the stamping table 609 in the arrow direction S, being postured vertically with the longitudinal side thereof directed horizontally. When the unit sheet-stack P2 transferred passes the sensor 604, the sensor 604 senses the color of the bundling tape of the unit sheet-stack P2 to produce a signal corresponding to the result of the sensing. Upon receiving the signal, the bundled unit sheet-stack classifying section 605 operates to classify the unit sheet-stack P2 passed the sensor P2 into a bundled normal unit sheet-stack P2N or a bundled soiled unit sheet-stack P2S and transfer the stacks individually. Specifically, when the sensor 604 produces a signal representing green, the normal sheet-stack classifying gate 623 guides the incoming bundled normal unit sheet-stack P2N toward the normal unit sheet-stack path 625. When the sensor 604 produces a sensing signal representing yellow, the soiled unit sheet-stack classifying gate 624 operates to guide the incoming bundled soiled unit sheet-stack P2S toward the soiled unit sheet-stack path 626. Accordingly, the paths 625 and 626 receive the normal unit sheet-stack P2N or the soiled unit sheet-stack P2S, successively transfer in the arrow direction T to stack them.

DISPLAY

Figure 13:
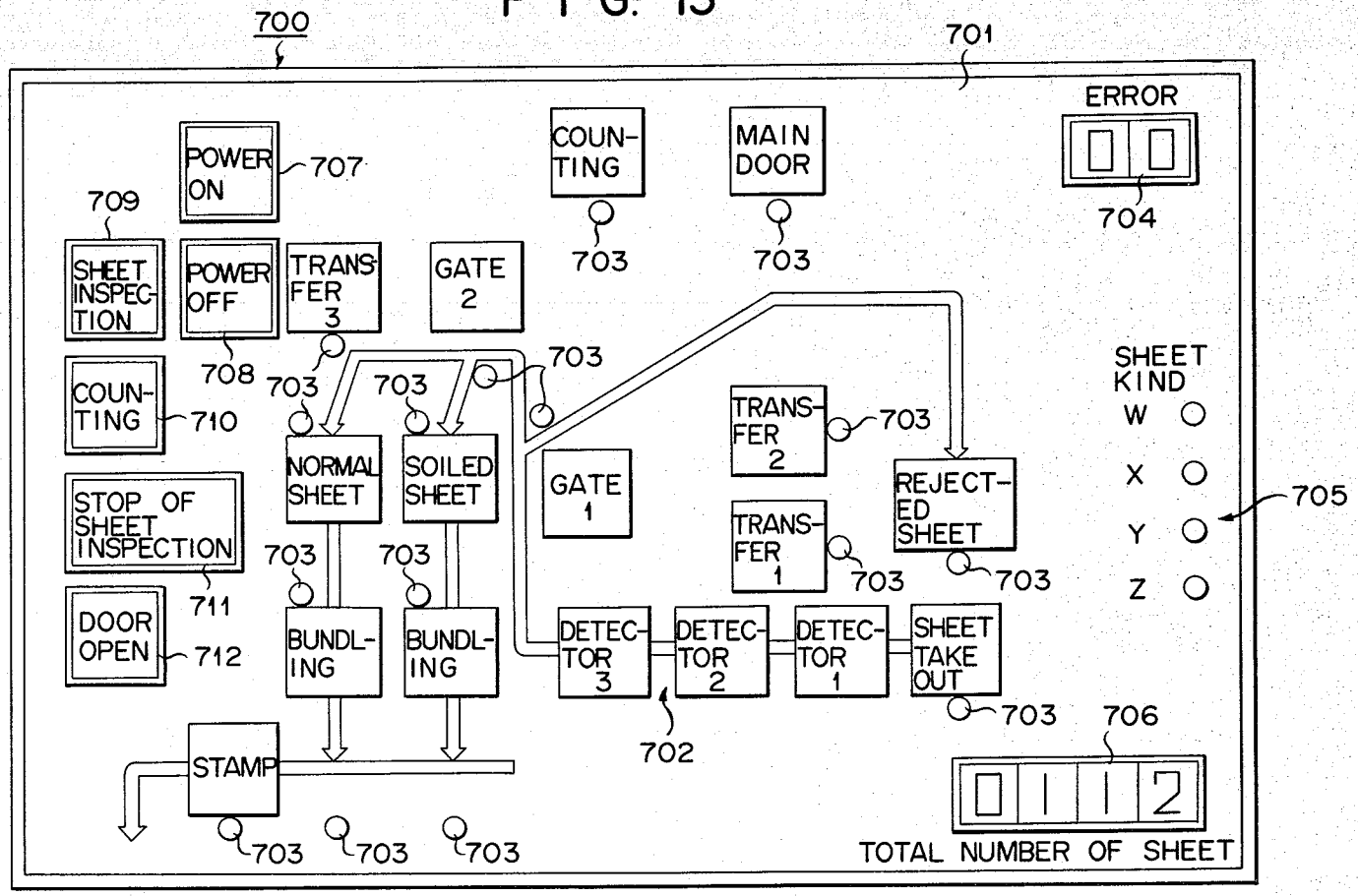
FIG. 13 is a plan view of a detail of a display device of the apparatus shown in FIG. 1.

The construction of the display device 700 is as illustrated in FIG. 13 in which a system block diagram 702 of the apparatus is depicted on a front panel 701. As shown, indicator lamps 703, 703, . . . which are lit when an abnormal condition such as jam takes place, are provided on the locations corresponding to the respective devices. Disposed on the panel 701, an error display 704, a group of lamps 705 for indicating the kind of the sheet to be processed, and a display window 706 for display the total number of the sheets processed (including the rejected sheets). The front panel 701 further includes: a power-on switch 707 for powering on the apparatus, a power-off switch 708 for powering off the same, a sheet inspection switch 709 used to check if the inspection device 200 performs the inspection operation or not, a switch 710 used for counting the number of sheets without classifying the sheets, a sheet inspection stop switch 711 used for stopping the inspecting operation of the inspection device 200, and a door open switch 712 used when the apparatus is operated in a state that a plurality of transparent doors (not shown) provided on the front panel corresponding to the respective devices, is left open. The switches 707 and 712 are of the glittering type.

Reference numeral 800 shown in FIG. 1 is an operating board including a processing start switch (FIG. 14A—916) and a continuous take-out switch (FIG. 14A—917), both of which are not illustrated. Reference symbols DS designate door switches for detecting the open of the transparent doors.

CONTROL

Referring now to FIGS. 14A and 14B, there is shown a block diagram of the control device. In the control device, reference numeral 900 designates a main control section comprising a microcomputer 901, a memory 902, a clock generator 903, and input/output port 904. The main control section 900 is connected to the inspection device 200 shown in FIG. 2 and a counter control section 905 which is further connected to normal sheet counters 906 and 907, soiled sheet counters 908 and 909, and total sheet counters 910 and 911. When receiving normal sheet, soiled sheet and the total sheet signals 223N, 223S and 223T, respectively, those counters 906, 908 and 910 count the number of the normal sheets, the number of the soiled sheets, and the total number of those sheets (not including rejected sheets) and produce the contents thereof toward a counter control section 905. On the other hand, the output signals from the normal sheet detector 314, the soiled sheet detector 315, and a true sheet detector 313 shown in FIG. 1 are applied to the respective counters 907, 909 and 911, respectively, so the number of the normal sheets, the number of the soiled sheets, and the number of true sheets, or the total number of those sheets are counted, respectively. Then, the contents of the counters are applied to a counter control section 905. The control section 905 compares the contents of the counters 906, 908 and 910 with the contents of the counters 907, 909 and 911, respectively. If there is found even a single pair of the signals not coincident, the counter control section 905 produces a signal designating the fact and transfers the signal to the main control section 900, thus preventing counting errors. The counter control section transfers the contents of the counters 906 to 911 to the main control section 900, as required. A record control unit 912, connected to the main control unit 900, is connected to a journal printer 913 for printing out the contents processed by the main control section 900.

The main control section 900 is connected to a display control section 914 and an operation control section 915. The display control section 915 is connected to the display lamps 703 shown in FIG. 13, the error contents display 704, the sheet-kind display lamps 705, and the sheet number display 706. The operation control section 915 is connected to the respective switches 707 to 712 shown in FIG. 13, the start switch 916 of the apparatus, the switch 917 for continuously taking out the sheets, and sheet-kind setting signal generators 918 to 920 for producing sheet-kind setting signals in response to the sheet-kind setting dials 113, 444 and 444 as shown in FIG. 1. The main control section 900 is also connected to a mechanism control section 921. Those components connected to the mechanism control section 921 are, for example, door switches DS shown in FIG. 1 a take-out and transfer control section 922 for controlling the sheet take-out/transfer device 100, a transfer/classifying control section 923 for controlling the sheet transfer/classifying device 300 shown in FIG. 1, and a plurality of the jam detectors 924. The jam detectors are provided on the transfer/classifying device 300 shown in FIG. 1. Further connected to the mechanism control section 921 are a stacking control section 925 for controlling the unit sheet-stack forming device 400 (FIG. 1), a bundling control section 926 for controlling the unit sheet-stack bundling device 500 (FIG. 1), a classifying control section 927 for controlling the bundled unit sheet-stack classifying device 600 (FIG. 1), and a plurality of jam detectors 928. The jam detectors 928 is provided on the transfer path of the bundled unit sheet-stack classifying 600 shown in FIG. 11.

The features of the unit sheet-stack forming device and the unit sheet-stack bundling device in the sheet like material processing apparatus according to the invention have thus been described in comparison with the unique conventional techniques. Those features will be summarized as follows:

(1) With respect to the unit sheet-stack forming device, for example, the normal unit sheet-stack forming device 400*a*, the unit sheet-stack is formed on the backup plate. The rotatory drums constituting the unit sheetstack bundling device directly receive the unit sheet-stack in a horizontal state from the back-up plate and clamp the unit sheet-stack to rotate by about 90°. Through this operation of the drums, the unit sheet-stack is postured in the substantially vertial state where the respective sheets are postured substantially vertically. The unit sheet-stack is pushed out to the bundling device while being postured vertically. When the unit sheet-stack is pushed out being in the vertical posture, it is very easy to divide the unit sheet-stack into the two sub-unit sheet-stacks and insert the leading end of the bundling tape between the sub-unit sheet-stacks. At this time, it is possible to prevent the stack of the unit sheet-stack from being destroyed. The bundling device directly receives the unit sheet-stack from the back-up plate, namely, without any special transfer path, so that the unit sheet-stack may be prevented from being destroyed on the midway of the transfer path. Further, a distance between the unit sheet-stack forming device and the unit sheet-stack bundling device may be remarkably reduced, and therefore the size off the apparatus may be made small.

(2) in the unit sheet-stack bundling device, a tape loop is previously formed into which the unit sheet-stack is inserted. The sheet-stack inserted is clamped at both sides thereof. The unit sheet-stack clamped in the stacked direction. Therefore, the leading end portion of the tape is held integrally. Therefore, the sheet-stack may be reliably bundled by merely squeezing the tape loop.

(3) The combination of the above-mentioned features enables the apparatus to process the sheet like material at a high speed and in a continuous manner.

What we claim is:

1. An apparatus for processing sheet like materials, comprising:

a unit sheet-stack transfer mechanism for (a) receiving at a first position a unit sheet-stack as a stack of a predetermined number of sheets of sheet like materials, the respective sheet like materials being postured substantially horizontally, and (b) transferring said stack to a second position whereat said respective sheets are postured substantially vertically;

a mechanism for forming a bundling loop for bundling said unit sheet-stack by winding into a loop a free end portion of a tape fed from a tape feeding source; and a bundling mechanism having means for inserting said unit sheet-stack into said bundling loop while said respective sheets thereof are postured in said substantially vertical state, means for tightening said bundling loop to squeeze said inserted unit sheet-stack, and means for bonding an outer end portion of said bundling loop tightened to an outer periphery portion of said bundling loop, wherein said bundling loop forming mechanism comprises:

first and second guide plates disposed at predetermined positions for guiding said unit sheet-stack when said unit sheet-stack is inserted into said bundling loop third and fourth guide plates arranged between said first and second guide plates and in parallel therewith, for guiding said free tape end;

rollers for feeding said free tape end between said third and fourth guide plates; and means for rotating said first to fourth guide plates in respective predetermined directions to thereby form said loop.

2. An apparatus according to claim 1, wherein said inserting means comprises:

a dividing plate for dividing said unit sheet-stack into first and second sub-unit sheet-stacks before said unit sheetstack is inserted into said bundling loop;

means for inserting said first sub-unit sheet-stack between said first and third guide plates and inserting said second sub-unit sheet-stack between said second and fourth guide plates; and means for retracting said first to fourth guide plates to integrally collect together said first sub-unit sheet-stack, said free end of the tape inserted between said third and fourth guide plates, and said second sub-unit sheet-stack and to nip the collected elements by clamping means.

3. An apparatus according to claim 1, wherein said unit sheet-stack transfer mechanism comprises:

a rotatable drum having a plurality of outer surface regions for bearing thereon said unit sheet-stack to be received in a substantially horizontal state, a fixed clamping plate and a movable clamp plate for tightly clamping both sides oppositely faces of said unit sheet-stack when said unit sheet-stack is placed on said outer surface region; and a mechanism for rotating said rotatory drum by about 90° while said unit sheet-stack is clamped and then causing said unit sheet-stack to stop.

4. An apparatus according to claim 1, wherein said bonding means includes adhesive supply means and a swingable squeezing roller, said adhesive supplying means being for supplying adhesive onto the inside of an external end portion of said tape loop squeezed by said bundling loop squeezing means, and said squeezing roller swings to make the inner surface of said external end portion supplied with said adhesive contact with the outer surface of said tape loop.

5. An apparatus according to claim 1, wherein a main surface of said inserted unit sheet-stack and the direction of said tape fed from said tape feeding source are selected such that when said inserted unit sheet-stack is squeezed, an angle formed between said main surface and tape feed direction is smaller than 90°.

6. An apparatus for processing sheet like materials comprising:

sheet take-out/transfer means for taking out sheets one by one from a stack of sheet like materials and feeding the sheets along a first transfer path;

inspection means provided along said first transfer path for inspecting the sheets to determine if they are normal, soiled or unidentifiable;

a sheet transfer device for transferring a sheet determined to be normal along a second transfer path and a sheet determined to be soiled along a third transfer path;

a normal unit sheet-stack forming device for receiving normal sheets from said second transfer path and stacking a predetermined number thereof in a vertical direction to obtain a normal unit sheet-stack; and a normal unit sheet-stack bundling means for receiving said normal unit sheet-stack, bundling it, and transferring the bundled unit sheet-stack to a fourth transfer path, the normal unit sheet-stack bundling device comprising:

a unit sheet-stack transfer mechanism for receiving said unit sheet stack at a first position whereat the respective sheets of the stack are postured substantially horizontally, and transferring said unit sheet-stack to a second position whereat the respective sheets of the stack are postured substantially vertically;

a mechanism for forming a bundling loop for bundling said unit sheet-stack by winding into a loop a free end portion of a tape fed from a tape feeding source, said bundling loop forming mechanism comprising first and second guide plates disposed at predetermined positions for guiding said unit sheet-stack when said unit sheet-stack is inserted into said bundling loop, third and fourth guide plates arranged between said first and second guide plates and in parallel therewith, for guiding the free end of said tape, rollers for feeding the free end of said tape between said third and fourth guide plates, and means for rotating said first to fourth guide plates in respective predetermined directions to thereby form said loop; and a bundling mechanism having means for inserting said unit sheet-stack into said bundling loop while said respective sheets are postured in said substantially vertical state, means for tightening said bundling loop to squeeze said inserted unit sheet-stack, and means for bonding an outer end portion of said bundling loop tightened to an outer periphery portion of said bundling loop.

7. An apparatus according to claim 6, wherein said normal unit sheet-stack forming device includes a back-up plate for carrying out said normal unit sheet-stack, said normal unit sheet-stack bundling device being disposed under said normal unit sheet-stack forming device, said unit sheet-stack transfer mechanism of said bundling device directly receiving said normal unit sheet-stack from said back-up plate.

8. An apparatus according to claim 6, further comprising:

a soiled unit sheet-stack forming device for receiving said soiled sheets from said third transfer path and stacking said soiled sheets by a given number of sheets in a vertical direction for obtaining a soiled unit sheet-stack; and a soiled unit sheet-stack bundling device for receiving said soiled unit sheet-stack, bundling said unit sheet-stack, and transferring the bundled unit sheet-stack to said fourth or a fifth transfer path;

said soiled unit sheet-stack forming device having substantially the same structure as that of said normal unit sheet-stack forming device and said soiled unit sheet-stack bundling device having substantially the same structure as that of said normal unit sheet-stack bundling device.

* * * * *